US006557989B1

(12) United States Patent
Hirosawa et al.

(10) Patent No.: US 6,557,989 B1
(45) Date of Patent: May 6, 2003

(54) PRINT HEAD AND INK JET PRINTING APPARATUS

(75) Inventors: Toshiaki Hirosawa, Hiratsuka (JP); Minoru Nozawa, Yokohama (JP); Riichi Saito, Fujisawa (JP); Shogo Kawamura, Numazu (JP); Toshimori Miyakoshi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 90 days.

(21) Appl. No.: 09/643,823

(22) Filed: Aug. 22, 2000

(30) Foreign Application Priority Data

Aug. 24, 1999 (JP) ..... 11-236279
Aug. 24, 1999 (JP) ..... 11-236994

(51) Int. Cl.[7] ..... B41J 2/175; B41J 2/17
(52) U.S. Cl. ..... 347/87; 347/94
(58) Field of Search ..... 347/87, 85, 94, 347/63, 65, 20

(56) References Cited

U.S. PATENT DOCUMENTS

| | | | | |
|---|---|---|---|---|
| 4,578,687 A | | 3/1986 | Cloutier et al. | 347/44 |
| 4,675,693 A | | 6/1987 | Yano et al. | 347/20 |
| 5,021,809 A | | 6/1991 | Abe et al. | 347/94 |
| 5,485,184 A | * | 1/1996 | Nakagomi et al. | 347/63 |
| 5,682,190 A | | 10/1997 | Hirosawa et al. | 347/94 |
| 5,777,649 A | | 7/1998 | Otsuka et al. | 347/94 |
| 5,867,195 A | | 2/1999 | Kaneko et al. | 347/92 |
| 5,969,736 A | * | 10/1999 | Field et al. | 347/85 |
| 6,244,698 B1 | * | 6/2000 | Chino et al. | 347/94 |
| 6,257,703 B1 | * | 7/2001 | Hirosawa et al. | 347/50 |

FOREIGN PATENT DOCUMENTS

| | | |
|---|---|---|
| EP | 0594110 | 4/1994 |
| EP | 0774356 | 5/1997 |
| EP | 0875385 | 11/1998 |
| EP | 875385 A2 | 11/1998 |
| EP | 0921000 | 6/1999 |
| EP | 0936070 | 8/1999 |
| JP | 6-210872 | 8/1994 |
| JP | 10-305592 | 11/1998 |

OTHER PUBLICATIONS

Patent Abstracts of Japan; Okada Junichi; "Ink Jet Head"; Jul. 6, 1984.

Patent Abstracts of Japan; Komata Koichi; "Ink Jet Recording Head and Apparatus"; Jul. 12, 1994.

* cited by examiner

*Primary Examiner*—Michael Nghiem
(74) *Attorney, Agent, or Firm*—Fitzpatrick, Cella, Harper & Scinto

(57) ABSTRACT

Disadvantages relating to ink refill specific to an increase in a number of ink ejection openings in an ink jet print head is eliminated to provide a particularly excellent fast-response capability and ejection performance. More specifically, when an ink is supplied to a liquid chamber via an ink supply path and an ink supply opening formed in a support member and a print element substrate in a print head, and is then ejected from ejection openings, a pressure of an ink effected upon the ejection is transmitted to the ink supply path. This pressure, however, can be absorbed by air chambers via communication paths to reduce adverse effects of the pressure on ink refill in the liquid path after the ejection. In this case, since the air chambers and other components are structured to be closed with respect to the atmosphere, problems such as an increase in viscosity which are associated with communication of the air chambers and other components with the atmosphere can be prevented.

4 Claims, 27 Drawing Sheets

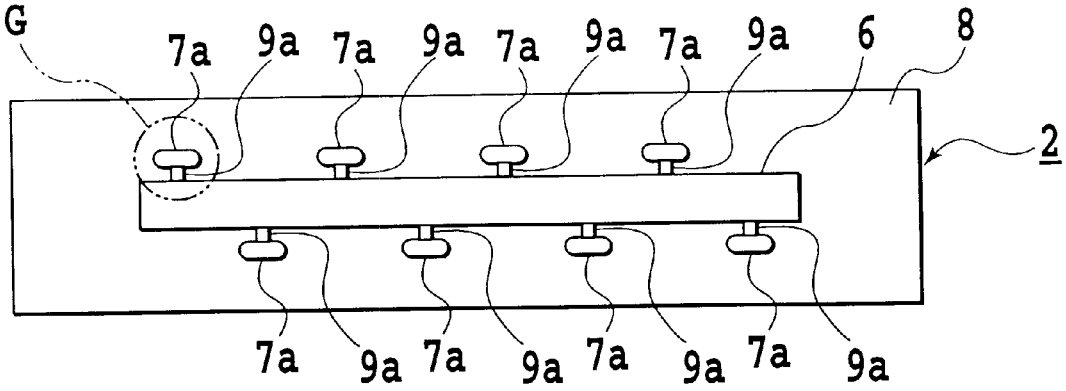
FIG.12A
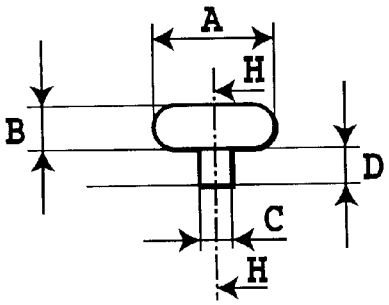
G DETAILED VIEW
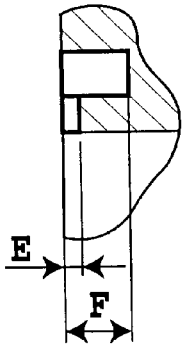
H-H SECTIONAL VIEW
FIG.12B
FIG.12C

PRINT HEAD AND INK JET PRINTING APPARATUS

This application is based on patent application Ser. Nos. 11-236279 filed Aug. 24, 1999 in Japan and 11-236994 filed Aug. 24, 1999 in Japan, the content of which is incorporated hereinto by reference.

BACKGROUND OF THE INVENTION

1. Field of the Invention

The present invention relates to a print head and an ink jet printing apparatus for using the print head, and particularly to a configuration for ink refill that is carried out in liquid paths of the print head in associated with ink ejection.

The present invention is applicable to general printing apparatuses, apparatuses such as copy machines, facsimile machines having a communication system, and word processors having a printing section, as well as industrial printing apparatuses combined with various processing apparatus in a compound manner.

2. Description of the Prior Art

Conventional printing apparatuses for printing data on printing medium such as a paper, a cloth, a plastic sheet, an OHP sheet or the like (hereafter simply referred to as "printing paper") are provided in a form of using a print head of various printing methods, for example, a wire dot method, a thermal-sensitive method, a thermal transfer method and an ink jet method.

The ink jet printing method carries out printing by ejecting an ink from fine openings for ink ejection (hereafter referred to "ejection openings") of a print head and depositing the ink on printing paper in accordance with printing information. This method has various advantages of enabling printing at a relatively high speed and enabling printing on plain paper easily.

In addition, the ink jet method can be roughly classified depending on an ink droplet forming method and an ejection energy generating method into the continuous method (including a charge grain control method and a spray method) and a on-demand method (including a piezo method, a spark method, and a bubble jet method).

The continuous method is what ejects continuously a charged ink and controls electric fields to deposit only required ink droplets on printing paper. Also, the method collects in an ink receiver part of the ink which is not required for printing. In contrast, the on-demand method is what ejects an ink as required for printing and thus efficiently uses the ink while avoiding ejecting an unnecessary ink to prevent an inside of the apparatus from being stained. On the other hand, the on-demand method employs an ink ejection operation basically including a start and a stop operations of an ink flow, and thus has a lower response frequency for driving of the head than the continuous method. Thus, a number of ejection openings is increased to improve a printing speed as a whole. Based on above points, many of the currently available ink jet printing apparatuses are based on the on-demand method.

A printing apparatus of such an ink jet method has a printing head that comprises ink ejection openings, liquid paths each in communication with a corresponding one of the ink ejection openings and ejection energy generating elements for generating energy in the corresponding liquid path to eject the ink. To carry out printing, the ejection energy-generating element is allowed to generate ejection energy to act on the ink in the corresponding liquid path to generate a pressure therein for ejection, so that the pressure is then used to eject the ink from the ejection opening.

The ink used for the ink jet printing is commonly a printing agent such as a pigment or a dye which is dissolved or dispersed into a solvent such as water, a water-soluble organic solvent, or a non-water-soluble organic solvent.

In an ink ejection operation performed in the print head described above, the pressure generated for ejection is transmitted via the ink in the liquid path both toward the corresponding ejection opening for ejection and toward a liquid chamber that supplies the ink to the liquid path. A part of the pressure which is transmitted toward the ejection opening pushes the ink in the liquid path out from the ink ejection opening to form a flying droplet.

When ejected ink leaves the ink ejection openings in form of droplet, a meniscus which is formed in the liquid path near the ejection opening moves back depending on an amount of the ejected droplet. A tension of the ink (capillary force) which pulls back the meniscus toward the ejection opening causes a filled state of the ink in the liquid path to be returned to that before the ejection after a certain amount of time has passed. This phenomenon is called "refill", and in actual printing, the above operation is repeated to achieve appropriate refill to enable stable persistent ink ejection.

The refill, however, may fail to be completed before the next ejection due to a cause associated with an ejection frequency or the like, and this incomplete refill may result in inappropriate ejection such as a reduced amount of the ejected ink droplet. As a result, for example, a size of ink dots formed with the ejected ink droplet on a printing medium is reduced to degrade general printing quality and an accuracy with which the ejected ink droplets land on the printing medium, causing blurred, rumpled, striped, or whitened images to be printed.

In printing techniques such as the ink jet printing method which use liquids, the above described problem has been solved by improving structures such as the liquid path or adjusting physical properties of the ink. Mere such improvements or adjustments, however, often fail to sufficiently improve a print head with a large number of ink ejection openings. This problem will be described below with reference to drawings.

FIGS. 20A and 20B are views showing cross sections of main parts of an ink jet print head as seen from an ink ejection direction. FIG. 20A is a view useful in explaining a pressure caused upon ink ejection and acting toward a common liquid chamber, and FIG. 20B is a view useful in explaining a pressure required to obtain an appropriate refill state.

A print head 100 comprises a large number of ejection openings (not shown), liquid paths 102 each in communication with a corresponding one of the ejection openings, ejection energy generators 103 each disposed in a corresponding one of the liquid paths 102, and a common liquid chamber 104 for supplying an ink to each of the liquid paths. The common liquid chamber 104 is in communication with an ink tank (also referred to as an "ink cartridge," not shown) via an ink supply port 105 and is thus constantly filled with the ink.

As shown in FIG. 20A, when the inks are ejected from the large number of ink ejection openings 101 simultaneously or with a delay between ejection timings, a pressure caused by the ejection in each of the liquid paths 102 is transmitted therefrom toward the common liquid chamber 104. These pressures are integrated together in the common liquid chamber 104 to form a single high pressure. The pressures caused in each liquid path act as forces that push back the ink toward the common liquid chamber 104 as shown by an arrow A, and the sum of these forces is several times as large as that in a print head with a single ejection opening.

In this case, to obtain a proper refill state, a large amount of ink must be rapidly moved toward the ejection openings 101 as shown by an arrow B in FIG. 20B, and to change the ink movement direction in this manner, a pressure is required which is sufficient to overcome an initial strong inertia force (total pressure) of the ink such as that described above.

However, a capillary force of the ink which causes the refill in each liquid path 102 is insufficient to instantaneously move a large amount of ink toward the ink ejection openings 101 against the total pressure toward the common liquid chamber 104. That is, as the above described initial inertia force during the ink movement increases, a larger amount of time is required to allow a meniscus 106 to recover. Then, if the ejection frequency is reduced to allow for the sufficient amount of time for the meniscus recovery, a printing speed will decline. On the other hand, if a sufficient amount of time cannot be allowed for the meniscus recovery, printing will be inappropriate, for example, a predetermined amount of ejected ink droplets are not obtained, as described above. In particular, such a phenomenon is known to be particularly significant at the beginning of printing.

FIGS. 21A and 21B are diagrams useful in explaining a mechanism of the above-described phenomenon. FIG. 21A is a diagram showing a meniscus move back curve, and FIG. 21B is a diagram showing a general configuration of the ink ejection opening and its neighborhoods.

The amount of meniscus move back (L$\mu$m) indicated on an axis of ordinate in FIG. 21A is expressed in terms of a length L measured from an end of the ejection opening 101 in the liquid path 102 as shown in FIG. 21B, and particularly corresponds to a distance between the ejection opening 101 and the furthest point to which the meniscus has receded.

For example, in the print head with a single ejection opening, the meniscus 106 formed in the liquid path 102 near the ink ejection opening at a point of time t0', which is a point of time after a certain amount of time from a point of time t0 when energy from the ejection energy generator 103 is applied to the ink in the liquid path 102, that is, at the point of time when ink ejection is performed, rapidly starts to recede, as shown by the curve labeled CM1 in FIG. 21A. The amount of move back reaches its maximum value at a point of time t1' and this value is relatively large. Subsequently, a recovery force based on the capillary force causes the meniscus 106 to return to its original position, and refill is completed at a point of time t1.

On the contrary, in the print head with a large amount of ink ejection openings, as shown by a curve CM2, the maximum amount of move back at t1' is smaller than that in the above described case, whereas a refill speed is lower as indicated by a move back completion time t2.

This is because the sum of pressures that push the ink from the large number of liquid paths 102 backward substantially exceeds the pressure that allows the ink to flow in the common liquid chamber 104 and because a portion of the sum which exceeds the latter pressure acts on the ink to significantly reduce the initial refill speed at which the meniscus 106 recovers.

Such a phenomenon is unlikely to occur after continuously repeated ejection because a steady flow of the ink from an ink supply tube 105 (see FIGS. 20A, 20B) to the common liquid chamber 104 has been formed. However, it is significant at the beginning of ejection, particularly, significant between the start of the ejection and a time at which about 200 times of ejection operation are performed to cause the ink flow to become steady.

In this case, the decrease in refill speed in the print head 110 with the large number of ink ejection openings 101 as described above poses no problem when a period used to apply a printing signal to the ejection energy generator 103 is set to be longer than the period between the points of time t0 and t2 shown in FIG. 21A. However, when a subsequent signal is applied in a period shorter than the period between the points of time t0 and t2 so that the refill has not been completed, for example, when the amount that the meniscus has receded is still 30$\mu$m or more for high-speed printing, a decrease in the amount of ejected ink droplets or the like may occur as described above to prevent proper printing.

Known means for solving these problems include a configuration provided with an open section to atmosphere in the common liquid chamber near the liquid path to absorb the pressure acting toward the common liquid chamber during ink ejection, as disclosed, for example, in U.S. Pat. No. 4,578,687. In this configuration, however, the common liquid chamber is open to the atmosphere, so that solvent components of the ink evaporate to make the ink in the print head more viscous or precipitate solids within the ink to block the liquid path and the ejection opening, resulting in frequent improper printing. Furthermore, vibration or the like may cause bubbles to be generated in the liquid chamber or a special design may be required to prevent dust or the like from entering the print head through the atmosphere open section. Therefore, this configuration is insufficiently practical.

Incidentally, the ejection energy generating elements such as an electromechanical converting element and an electro-thermal converting element (thermal energy generation resistor), which are well known, are put in practical use in an ink-jet printing. Among them, a bubble jet method using the electro-thermal converting element, which heats a liquid contacting thereto so as to evaporate the liquid for making the bubble during extremely short time, shows a following behavior of the ink with respect to the refill. A part of the liquid (mainly the liquid disposed in an ejection opening side of a liquid path including the electro-converting element) is pressed to move towards the ejection opening and other liquid in the liquid path is pressed to move towards an ink supply path. The bubble forms an interface between a liquid and a gas on the above behavior. Accordingly, when continuous ink ejection is performed, generation and disappearance of the bubble at a high frequency cause a movement of the liquid. Many proposals such as providing a dummy nozzle and a dummy hole have been made with respect to the refill in order to dissolve a problem of the high frequency vibration of the liquid.

On the other hand, as an ejection method of the bubble jet method, two kinds of ejection methods are known. Respective behaviors of the refill will be explained as follows, correspondingly to respective ejection methods.

(move back and return of the meniscus in an ordinary ejection method of the bubble jet method)

Upon a process in which a liquid droplet is formed from the liquid and is ejected, a front surface of the liquid remaining in a nozzle forms the meniscus. Upon a process in which the bubble is disappeared, the meniscus formed at the front surface of the liquid is moved back in a retracting manner by an action of the disappearance of the bubble. At the same time, the interface between the gas and the liquid, which is formed as a back boundary part of the bubble, is moved towards the front also by the action of the disappearance of the bubble. That is, the process of the disappearance of the bubble per se functions as a part of driving force for making the interface positioned at the back of the electro-thermal converting element and the liquid contacted thereto return to the front of the nozzle.

(move back and return of the meniscus in an ejection method of so called bubble through jet type)

This method is featured that the bubble generated by the thermal energy caused by the electro-thermal converting element communicates with an air before the liquid droplet is ejected from the nozzle. Accordingly, the process for disappearance of the bubble described above does not exist and the interface between the gas and the liquid as back boundary part of the bubble forms the meniscus which has been moved back. At a front of the meniscus moved back, an area of the air, whose pressure is substantially the same as that of atmosphere, is formed. The meniscus returns to the front of the nozzle with pressing the air (having substantially the pressure of the atmosphere). According to a consideration with respect to a printing head having the liquid path of the same dimension to the printing head of the ordinary ejection method, since the action accompanied with the disappearance of the bubble does not exist when the meniscus returns to the front, the refill is performed by a capillary force of the liquid path.

Following two prior arts are known as arts regarding ink supply in the printing head of the above described bubble jet type.

Japanese Patent Application Laid-open No. 10-305592 (1998) discloses relatively large chamber provided for receiving fine bubbles which is disposed around an ink supply path. Fine bubbles separated from the bubble for ejection become so many in a liquid chamber and then ejection failure may be caused. An ordinary method performs a suction recovery operation for preventing the ejection failure due to the fine bubbles from being caused. In contrast, the prior art provides the large chamber for receiving the fine bubbles. The chamber has only the liquid therein at beginning of use of a printing head. Then, the fine bubbles increase in the chamber with use of the head and when the chamber is filled with the fine bubbles the head integrally having an ink tank is exchanged by new one for preventing the liquid supply path from receiving the fine bubbles.

Japanese Patent Application Laid-open No. 6-210872 (1994) discloses that an air chamber (a buffer chamber) is provide at an opposite and back side to nozzles with respect to a common chamber. Providing the buffer chamber near the nozzles allows a vibration (high frequency vibration) of a liquid caused by driving for ejection, generating the bubble and ejection of the respective nozzles to be decreased so as to prevent ejection of other nozzle from being affected. That is, the prior art discloses prevention of a crosstalk.

The prior art also discloses that a head unit, a ink supply tube for supplying ink to the head unit and an air chamber formed at a connection portion between the head unit and the ink supply tube are provided along a path from an ink tank section to a head section. Especially in FIG. 12 of the prior art, the air chamber is formed around the ink supply tube having constant section area.

SUMMARY OF THE INVENTION

An first object of the present invention is to improve a function of an air buffer which eliminates or decreases an effect of a vibration of a liquid caused along a liquid supply path from an ink supply source (an ink tank and the like) to a head chip (including a plurality of liquid path and a liquid chamber) comprising a liquid ejection element like a prior art, among vibrations of liquid caused in a printing head.

The present invention is made especially by considering an arrangement of the air buffer as well as a configuration of the air buffer and a relation between the air buffer and surrounding elements.

A second object of the present invention is to eliminate or decrease an effect of a low frequency vibration of a liquid upon an ejection behavior. This object is based on following consideration. In a bubble through jet method, the low frequency vibration may affect a capillary force which functions as a driving force for a refill of a liquid so that the refill is performed insufficiently or is performed too much to cause ejection failure.

Further object of the present invention is to provide a structure for effectively manufacturing an air buffer.

In a first aspect of the present invention, there is provided a print head comprising:

a print element substrate having a substrate on which an ejection energy generating element for generating thermal energy that is used for ejecting ink is provided, and an ejection opening plate which is provided on the substrate and in which an ejection opening is provided so that the ejection opening faces the ejection energy generating element; and a support member being contact with the substrate to support the print element substrate, wherein an ink supply path for supplying the ink to the ejection opening on print element substrate, and an air chamber communicating the ink supply path and including an air are provided, and at least a part of inner wall of the air chamber is formed with the support member.

In a second aspect of the present invention, there is provided an ink jet printing apparatus comprising:

a print head including:

a print element substrate having a substrate on which an ejection energy generating element for generating thermal energy that is used for ejecting ink is provided, and an ejection opening plate which is provided on the substrate and in which an ejection opening is provided so that the ejection opening faces the ejection energy generating element; and a support member being contact with the substrate to support the print element substrate, wherein an ink supply path for supplying the ink to the ejection opening on print element substrate, and an air chamber communicating the ink supply path and including an air are provided, and at least a part of inner wall of the air chamber is formed with the support member; and In a third aspect of the present invention, there is provided an ink jet head comprising:

a head chip including a plate which is provided with a plurality of liquid flow paths, liquid ejection elements corresponding to the plurality of liquid flow paths respectively and liquid ejection opening corresponding to the liquid ejection elements respectively, and in which a through hole space receiving a liquid is formed; and a liquid supply unit having a liquid supply path for supplying the liquid from a liquid supply source to the head chip, wherein the plurality of liquid flow paths are arranged as a group in the head chip, and a communication portion communicating with the liquid supply path and forming an interface between a gas and a liquid and a gas retaining chamber which has larger volume than that of the communication portion and retains a gas, are provided at one end and another end of the group.

In a fourth aspect of the present invention, there is provided an ink jet head comprising:

a head chip including a plate which is provided with a plurality of liquid flow paths, liquid ejection elements corresponding to the plurality of liquid flow paths respectively and liquid ejection opening corresponding to the liquid ejection elements respectively, and in which a through hole space receiving a liquid is formed; and a liquid supply unit having a liquid supply path which supplies the liquid from a liquid supply source to the head chip and has inclined portion, wherein a gas retaining chamber retaining a gas is disposed at a position capable of receiving a component of liquid movement of a different direction, which is caused by the inclined portion of the liquid supply path, from a direction of liquid supply.

In a fifth aspect of the present invention, there is provided an ink jet head comprising:

a head chip including a plate which is provided with a plurality of liquid flow paths, liquid ejection elements corresponding to the plurality of liquid flow paths respectively and liquid ejection opening corresponding to the liquid ejection elements respectively, and in which a through hole space which has an inclined portion and receive a liquid is formed; and a liquid supply unit having a liquid supply path which supplies the liquid from a liquid supply source to the head chip and has inclined portion, wherein a gas retaining chamber retaining a gas is disposed near a position where an elongated line of the inclined portion of the through hole space crosses an elongated line of the inclined portion of the liquid supply path.

In a sixth aspect of the present invention, there is provided an ink jet head comprising:

a head chip including a plate which is provided with a plurality of liquid flow paths, liquid ejection elements corresponding to the plurality of liquid flow paths respectively and liquid ejection opening corresponding to the liquid ejection elements respectively, and in which a through hole space which has an inclined portion and receive a liquid is formed; and a liquid supply unit having a liquid supply path which supplies the liquid from a liquid supply source to the head chip and has inclined portion, wherein a gas retaining chamber retaining a gas is disposed at a position which a surface of the inclined portion of the through hole space and a surface of the inclined portion of the liquid supply path face respectively.

According to the above configuration, the air chambers, which communicates with the ink supply chamber common to the plurality of ink ejection openings for supplying the ink to these ink ejection openings and to which the pressure is transmitted from the ink supply chamber, is provided. Accordingly, the pressure caused upon ejection of the ink in each ejection opening and propagated to the ink supply chamber also propagates to the air chamber as a change in the pressure of the air in the air chamber and is absorbed due to a compression of an air in the air chamber.

In addition, since the air chambers are provided at the opposite side of the ejection openings with respect to the print element substrate, the air chamber does not communicate with the atmosphere, thereby preventing the ink in the print head from being made more viscous through the air chambers.

Furthermore, since an inner wall of the air chamber is formed with the support member, the air chamber can be disposed at an area relatively nearer to a portion for ink ejection.

When two members at lest of which has a recess are connected to each other in a manner that the recess is position at connection face side, the air chamber of a seal structure can be easily manufactured.

The air chamber communicates with the ink supply path at end of an inclined portion of an inner wall of a through hole forming the ink supply path so that a buffer action caused by the inclined portion and a buffer action caused by the air chamber meet to provide further stable ink supply characteristic.

The ink supply path has a bend portion at an upper stream side than the air chamber so that a buffer action caused by the bend portion and the buffer action caused by the air chamber meet to provide further stable ink supply characteristic.

In addition, in a bubble through jet method, the buffer action caused by the air chamber can be more effectively shown to realize high level of the buffer action.

The above and other objects, features and advantages of the present invention will become more apparent from the following description of embodiments thereof taken in conjunction with the accompanying drawings.

BRIEF DESCRIPTION OF THE DRAWINGS

FIG. 12A is a detailed top view and sectional view of the main part shown in FIG. 11, FIGS. 12B and 12C are sectional views showing the part;

DETAILED DESCRIPTION OF THE PREFERRED EMBODIMENTS

Embodiments of the present invention will be described below in detail with reference to the drawings.

A printer will be explained below as an example of an ink jet printing apparatus using a seal rubber according to one embodiment of the present invention.

A term "printing", as used herein, refers to formation of images, patterns, or the like on a printing medium or processing of the printing medium whether meaningful information such as characters, graphics, or the like or meaningless information is to be formed or whether or not the information is embodied so as to be visually perceived by human beings.

A term "printing medium", as used herein, refers not only to paper for use in general printing apparatuses but also to materials such as cloths, plastic films, metal plates, glass, ceramics, woods, and leathers which can receive inks.

Furthermore, a term "ink" (or "liquid") should be broadly interpreted as in a definition of the above term "printing", and refers to a liquid that is applied to the printing medium to form images, patterns, or the like, process the printing medium, or process the ink (for example, solidify or insolubilize a coloring material in the ink applied to the printing medium).

1. Apparatus Body

Figure 1:
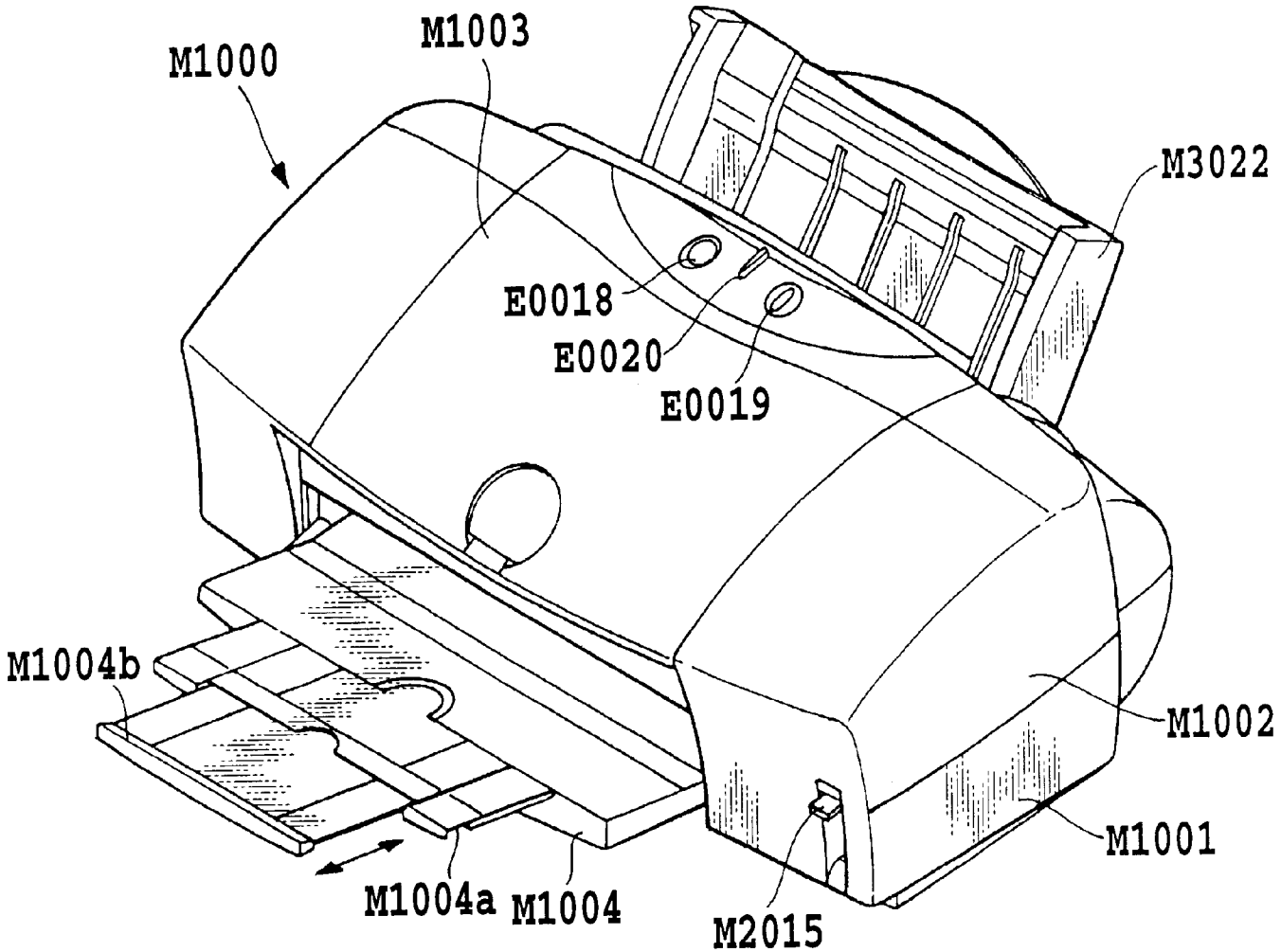
FIG. 1 is a perspective view showing an external construction of an ink jet printer as one embodiment of the present invention.
Figure 2:
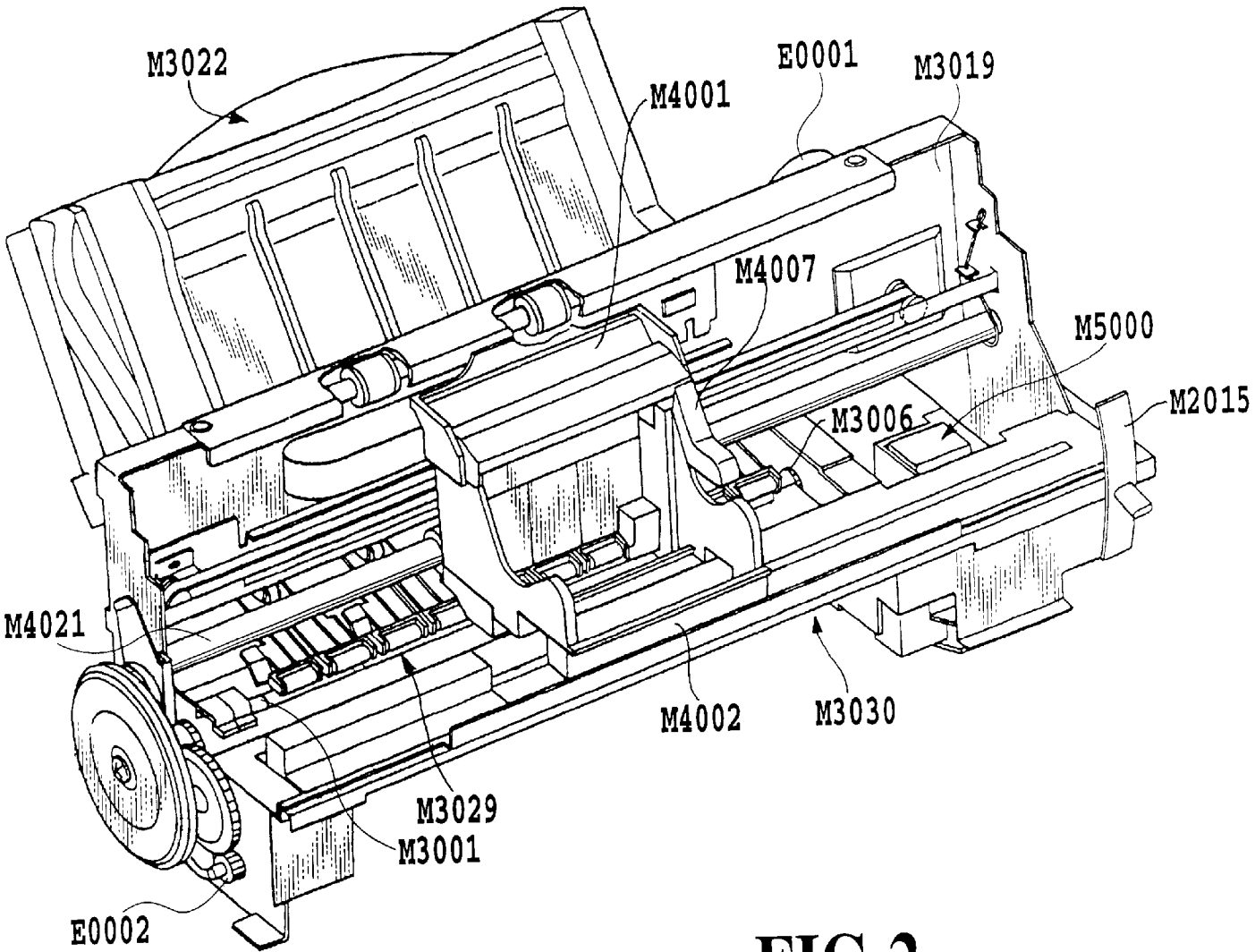
FIG. 2 is a perspective view showing the printer of FIG. 1 with an enclosure member removed.

FIGS. 1 and 2 show an outline construction of a printer using an ink jet printing system. In FIG. 1, a housing of a printer body M1000 of this embodiment has an enclosure member, including a lower case M1001, an upper case M1002, an access cover M1003 and a discharge tray M1004, and a chassis M3019 (see FIG. 2) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has an opening in its top portion and front portion.

The discharge tray M1004 has one end portion thereof rotatably supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color.

Further, a buzzer E0021 (FIG. 7) may be sounded. When the trouble is eliminated, the resume key E0019 is pressed to resume the printing.

2. Printing Operation Mechanism

Next, a printing operation mechanism installed and held in the printer body M1000 according to this embodiment will be explained.

The printing operation mechanism in this embodiment comprises: an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit to perform a desired printing on the print sheet carried to the print position; and an ejection performance recovery unit M5000 to recover the ink ejection performance of the print unit.

Here, the print unit will be described. The print unit comprises a carriage M4001 movably supported on a carriage shaft M4021 and a print head cartridge H1000 removably mounted on the carriage M4001.

2.1. Print Head Cartridge

First, the print head cartridge used in the print unit will be described with reference to FIGS. 3 to 5.

Figure 3:
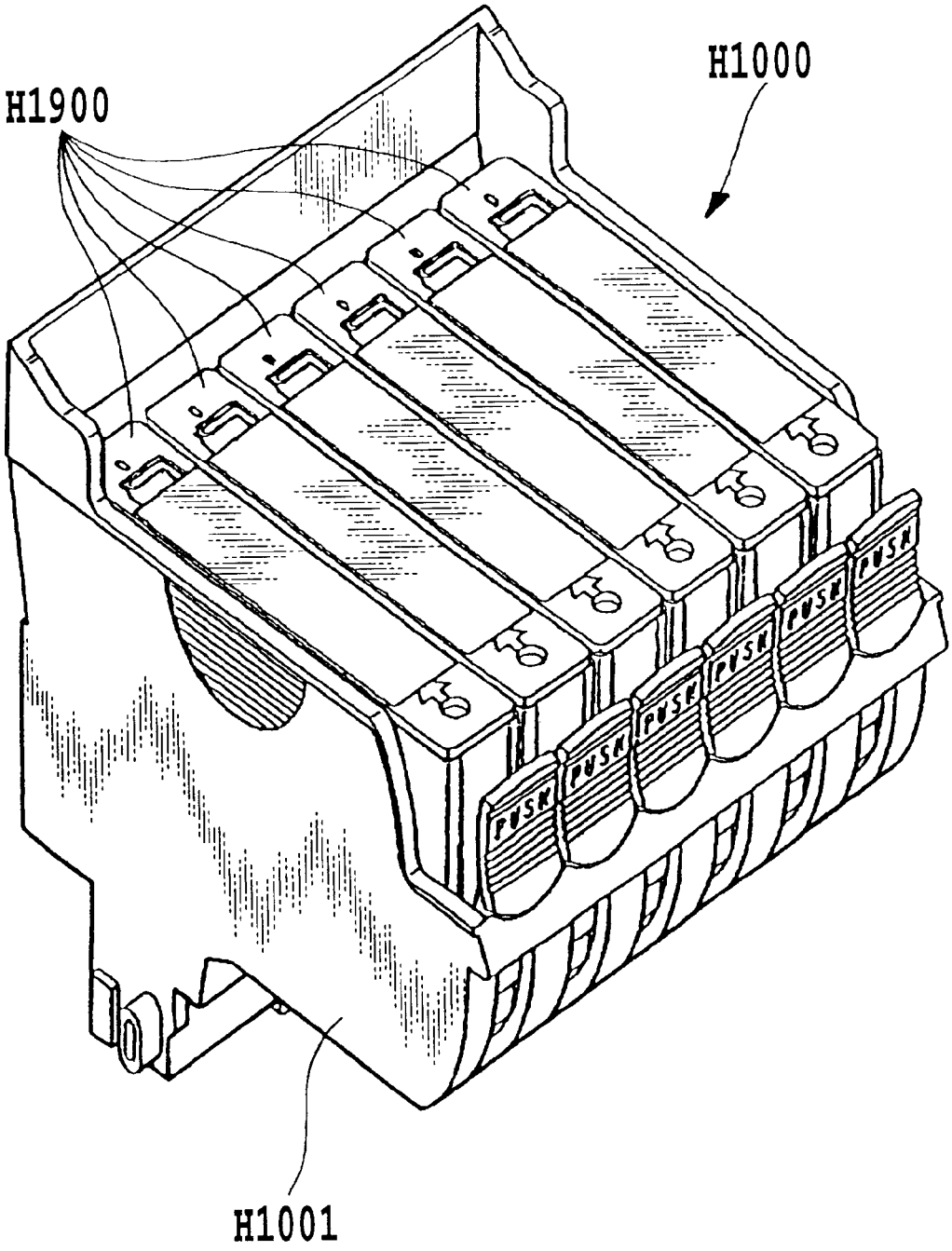
FIG. 3 is a perspective view showing an assembled print head cartridge used in the printer of one embodiment of the present invention.
Figure 4:
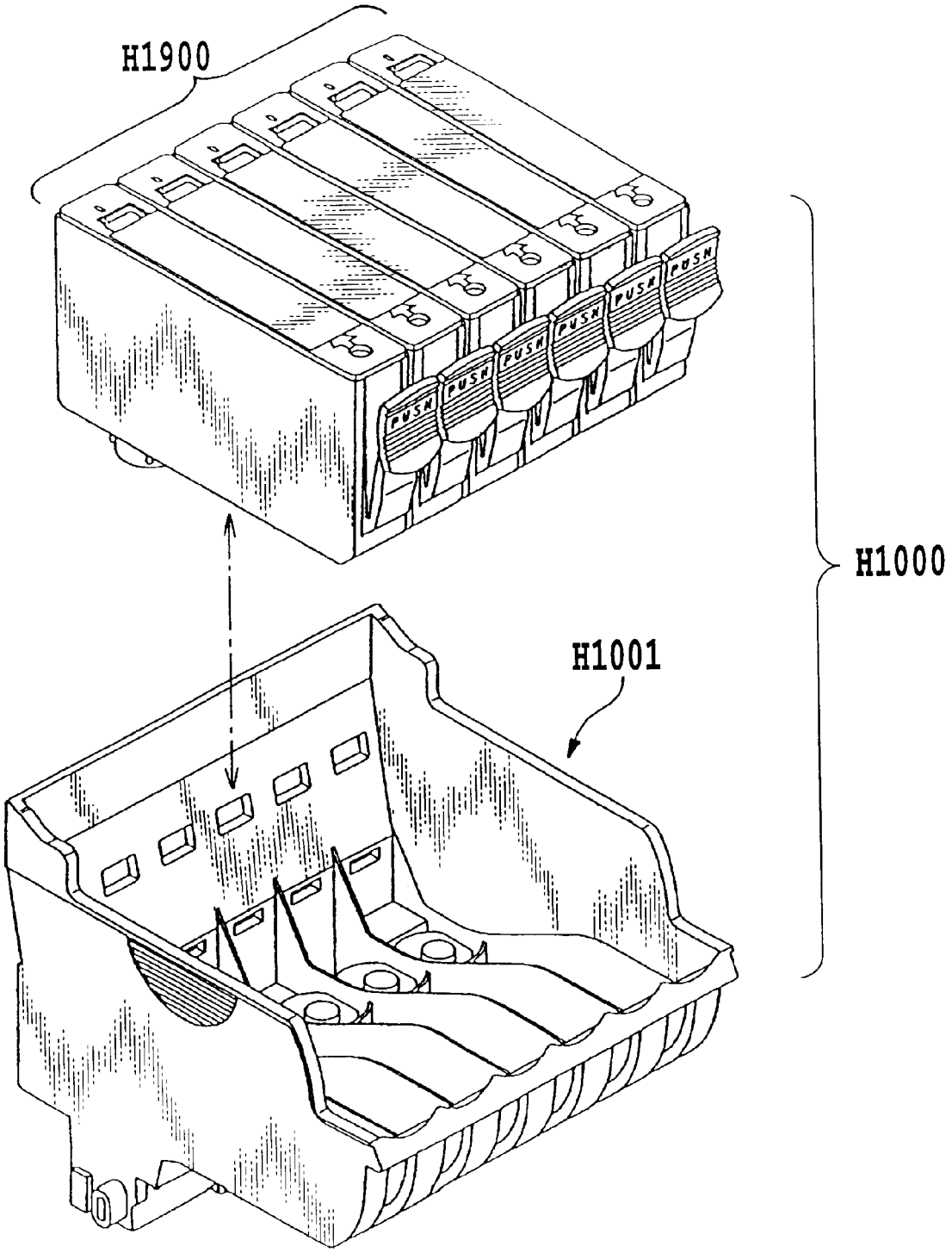
FIG. 4 is an exploded perspective view showing the print head cartridge of FIG. 3.

The print head cartridge H1000 in this embodiment, as shown in FIG. 3, has an ink tank H1900 containing inks and a print head H1001 for ejecting ink supplied from the ink tank H1900 out through nozzles according to print information. The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as photograph. As shown in FIG. 4, these individual ink tanks are removably mounted to the print head H1001.

Figure 5:
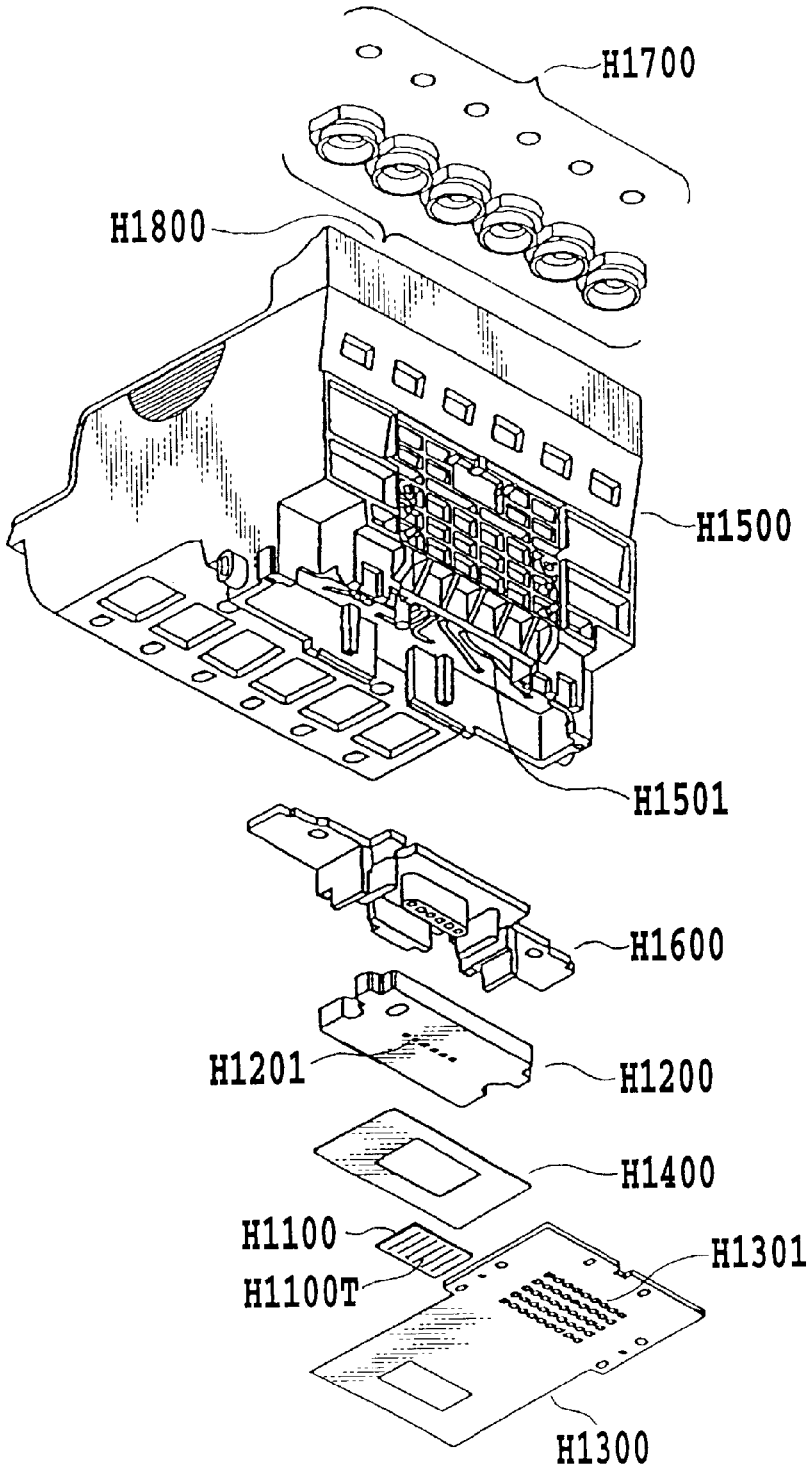
FIG. 5 is an exploded perspective view of the print head of FIG. 4 as seen diagonally below.

Then, the print head H1001, as shown in the perspective view of FIG. 5, comprises a print element substrate H1100, a first plate H1200, an electric wiring board H1300, a second plate H1400, a tank holder H1500, a flow passage forming member H1600, a filter H1700 and a seal rubber H1800.

The print element silicon substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages. The print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate H1100 and external signal input terminals H1301 situated at electric wires' ends for receiving electric signals from the printer body. The external signal input terminals H1301 are positioned and fixed at the back of a tank holder H1500 described later.

The tank holder H1500 that removably holds the ink tank H1900 is securely attached, as by ultrasonic fusing, with the flow passage forming member H1600 to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800, and the print element unit, which includes the print element substrate H1100, the first plate H1200, the electric wiring board H1300 and the second plate H1400, are combined as by adhesives to form the print head H1001.

2.2. Carriage

Next, by referring to FIG. 2, the carriage M4001 carrying the print head cartridge H1000 will be explained.

As shown in FIG. 2, the carriage M4001 has a carriage cover M4002 for guiding the print head H1001 to a predetermined mounting position on the carriage M4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printed cable (see FIG. 7: simply referred to as a contact FPC hereinafter) E0011 whose contact portion electrically contacts a contact portion (external signal input terminals) H1301 provided in the print head H1001 to transfer various information for printing and supply electricity to the print head H1001.

Between the contract portion of the contact FPC E0011 and the carriage M4001 there is an elastic member not shown, such as rubber. The elastic force of the elastic member and the pressing force of the head set lever spring combine to ensure a reliable contact between the contact portion of the contact FPC E0011 and the carriage M4001. Further, the contact FPC E0011 is connected to a carriage substrate E0013 mounted at the back of the carriage M4001 (see FIG. 7).

3. Scanner

The printer of this embodiment can mount a scanner in the carriage M4001 in place of the print head cartridge H1000 and be used as a reading device.

The scanner moves together with the carriage M4001 in the main scan direction, and reads an image on a document fed instead of the printing medium as the scanner moves in the main scan direction. Alternating the scanner reading operation in the main scan direction and the document feed in the subscan direction enables one page of document image information to be read.

Figure 6B:
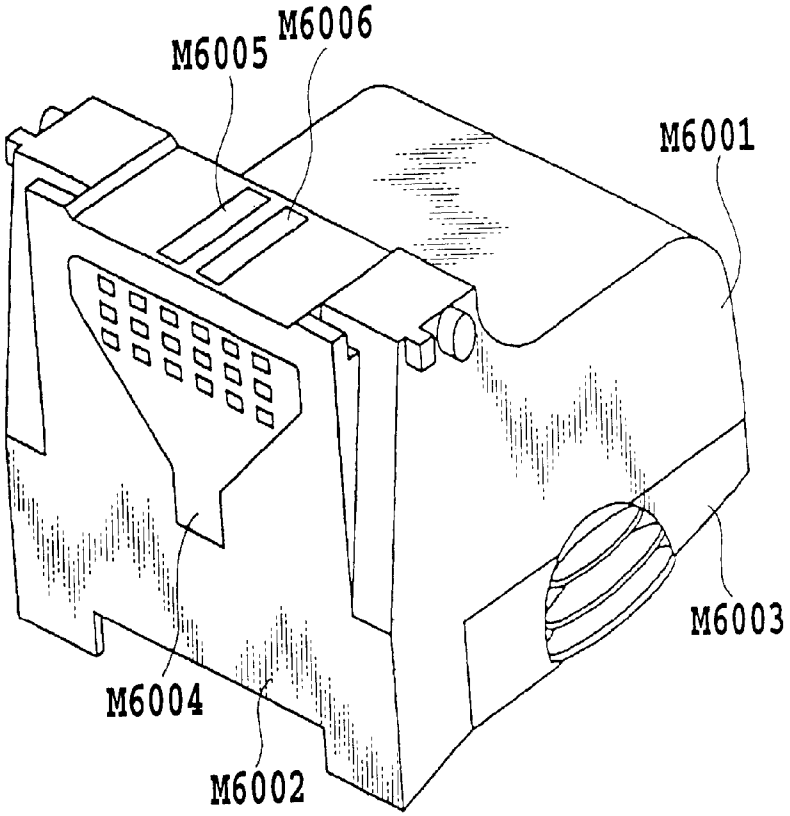
FIGS. 6A and 6B are perspective views showing a construction of a scanner cartridge upside down which can be mounted in the printer of one embodiment of the present invention instead of the print head cartridge of FIG. 3.
Figure 6A:
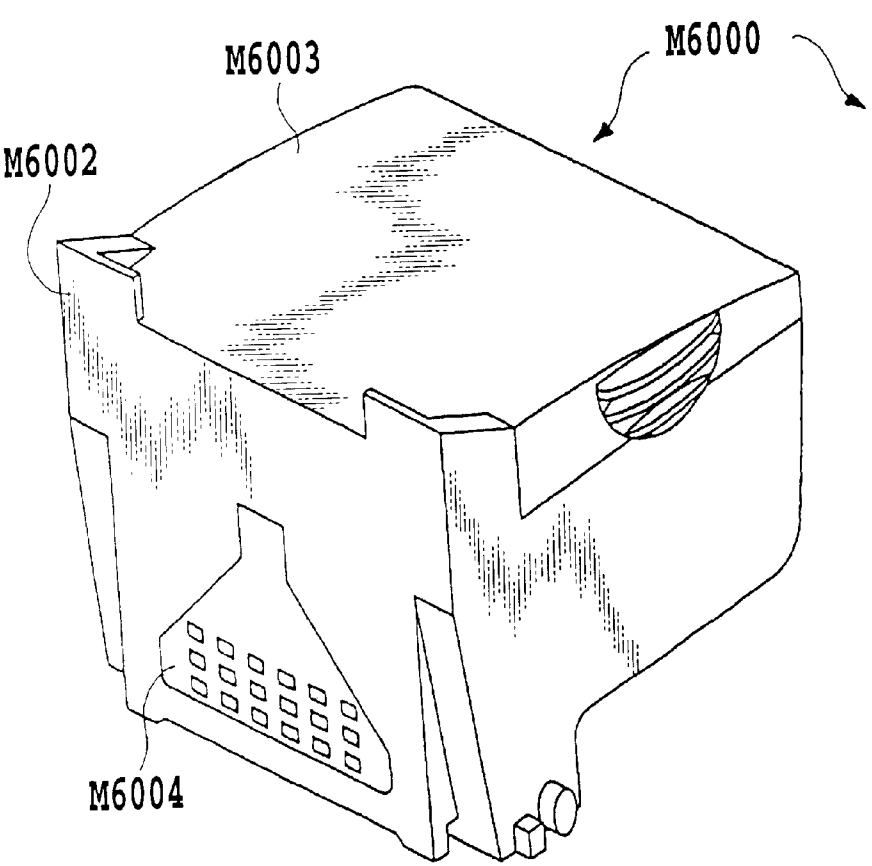

FIGS. 6A and 6B show the scanner M6000 upside down to explain about its outline construction.

As shown in the figure, a scanner holder M6001 is shaped like a box and contains an optical system and a processing circuit necessary for reading. A reading lens M6006 is provided at a portion that faces the surface of a document when the scanner M6000 is mounted on the carriage M4001. The lens M6006 focuses light reflected from the document surface onto a reading unit inside the scanner to read the document image. An illumination lens M6005 has a light source not shown inside the scanner. The light emitted from the light source is radiated onto the document through the lens M6005.

The scanner cover M6003 secured to the bottom of the scanner holder M6001 shields the interior of the scanner holder M6001 from light. Louver-like grip portions are provided at the sides to improve the ease with which the scanner can be mounted to and dismounted from the carriage M4001. The external shape of the scanner holder M6001 is almost similar to that of the print head H1001, and the scanner can be mounted to or dismounted from the carriage M4001 in a manner similar to that of the print head H1001.

The scanner holder M6001 accommodates a substrate having a reading circuit, and a scanner contact PCB M6004 connected to this substrate is exposed outside. When the scanner M6000 is mounted on the carriage M4001, the scanner contact PCB M6004 contacts the contact FPC E0011 of the carriage M4001 to electrically connect the substrate to a control system on the printer body side through the carriage M4001.

4. Example Configuration of Printer Electric Circuit

Next, an electric circuit configuration in this embodiment of the invention will be explained.

Figure 7:
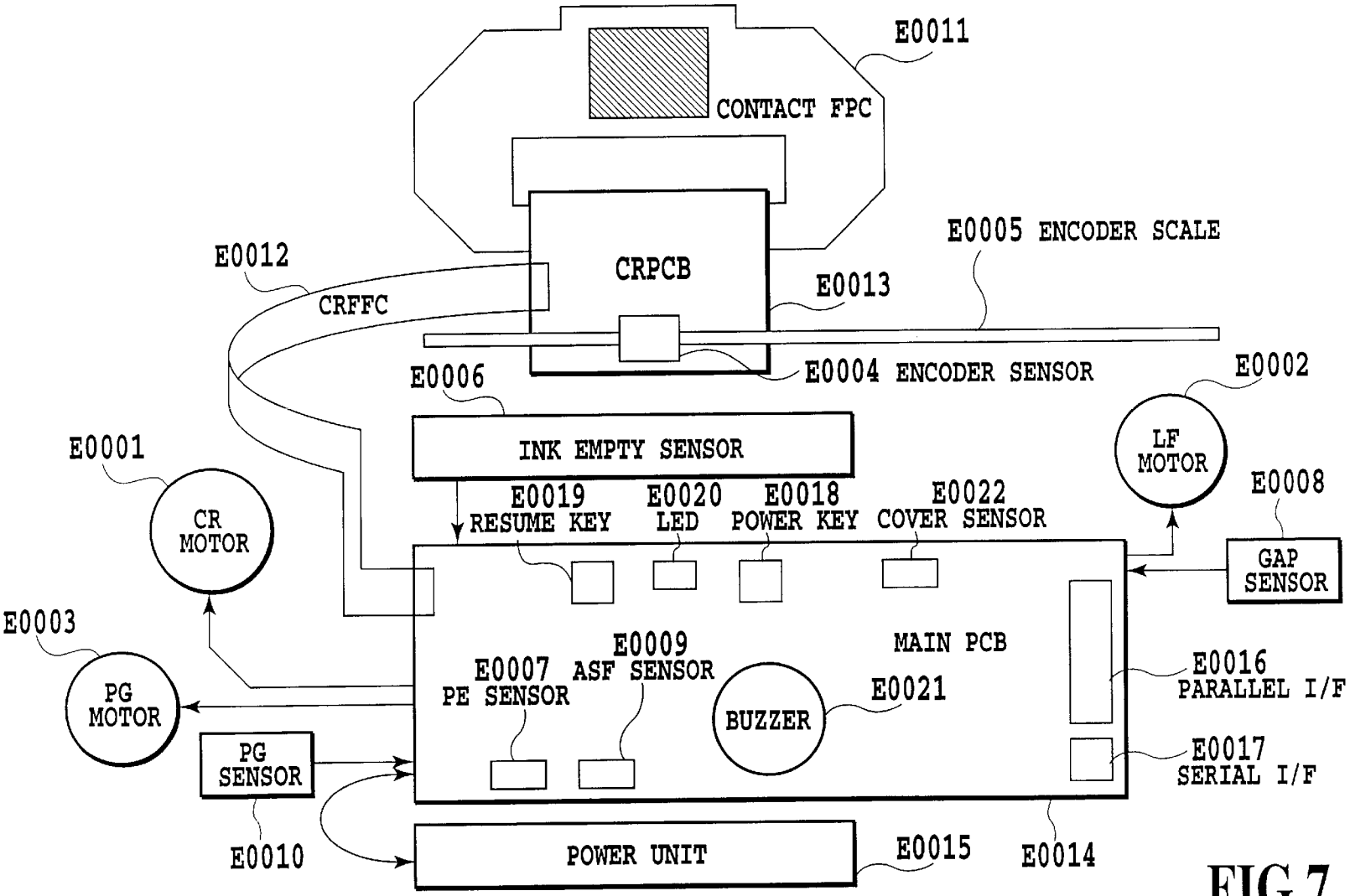
FIG. 7 is a block diagram schematically showing the overall configuration of an electric circuitry of the printer according to one embodiment of the present invention.

FIG. 7 schematically shows the overall configuration of the electric circuit in this embodiment.

The electric circuit in this embodiment comprises mainly a carriage substrate (CRPCB) E0013, a main PCB (printed circuit board) E0014 and a power supply unit E0015.

The power supply unit E0015 is connected to the main PCB E0014 to supply a variety of drive power.

The carriage substrate E0013 is a printed circuit board unit mounted on the carriage M4001 (FIG. 2) and functions as an interface for transferring signals to and from the print head through the contact FPC E0011. In addition, based on a pulse signal output from an encoder sensor E0004 as the carriage M4001 moves, the carriage substrate E0013 detects a change in the positional relation between an encoder scale E0005 and the encoder sensor E0004 and sends its output signal to the main PCB E0014 through a flexible flat cable (CRFFC) E0012.

Further, the main PCB E0014 is a printed circuit board unit that controls the operation of various parts of the ink jet printing apparatus in this embodiment, and has I/O ports for a paper end sensor (PE sensor) E0007, an automatic sheet feeder (ASF) sensor E0009, a cover sensor E0022, a parallel interface (parallel I/F) E0016, a serial interface (Serial I/F) E0017, a resume key E0019, an LED E0020, a power key E0018 and a buzzer E0021. The main PCB E0014 is connected to and controls a motor (CR motor) E0001 that constitutes a drive source for moving the carriage M4001 in the main scan direction; a motor (LF motor) E0002 that constitutes a drive source for transporting the printing medium; and a motor (PG motor) E0003 that performs the functions of recovering the ejection performance of the print head and feeding the printing medium. The main PCB E0014 also has connection interfaces with an ink empty sensor E0006, a gap sensor E0008, a PG sensor E0010, the CRFFC E0012 and the power supply unit E0015.

Figures 8, 8A:
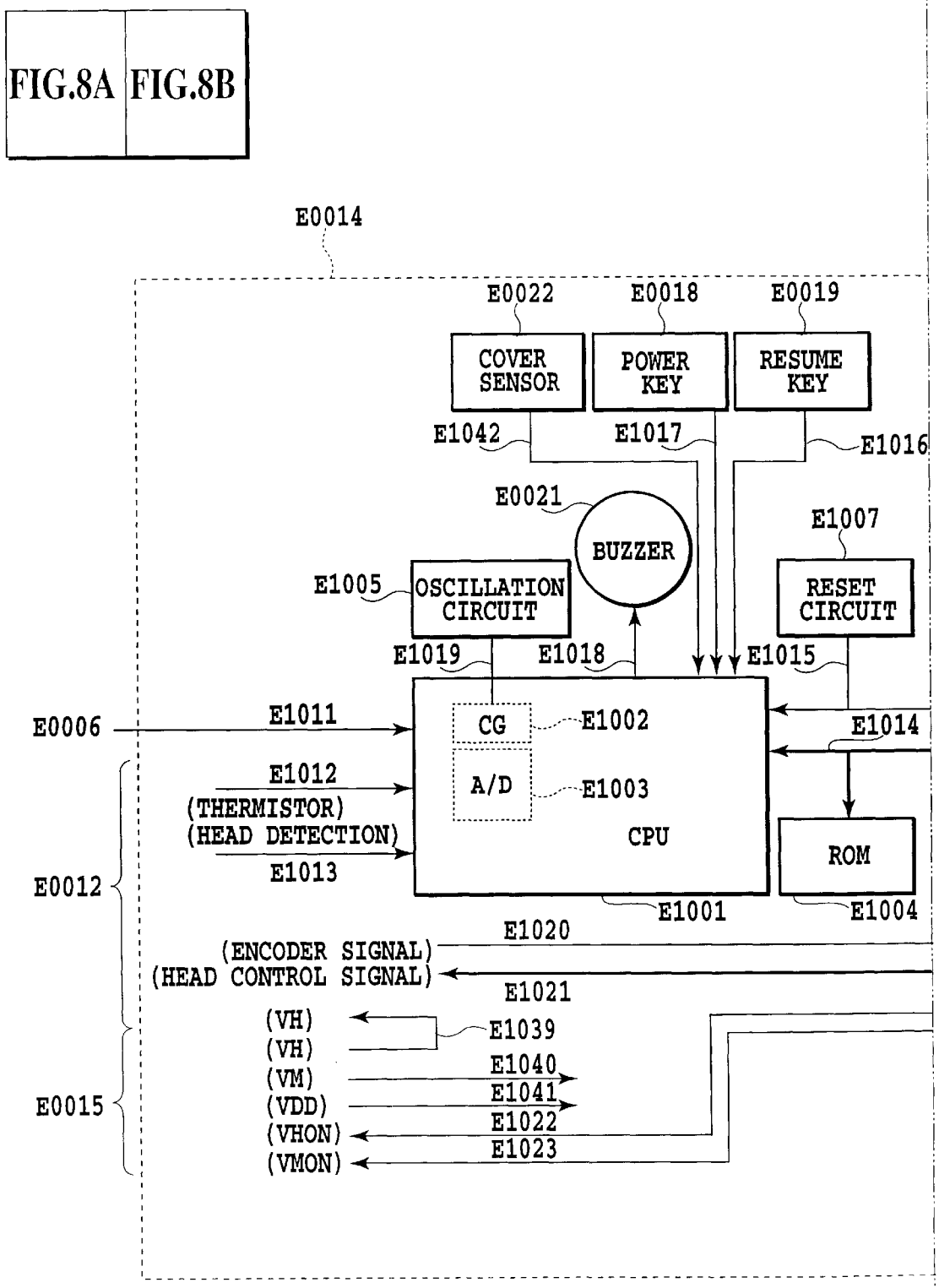
FIG. 8 is a diagram showing the relation between FIGS. 8A and 8B, FIGS. 8A and 8B being block diagrams representing an example inner configuration of a main printed circuit board (PCB) in the electric circuitry of FIG. 7.
Figure 8B:
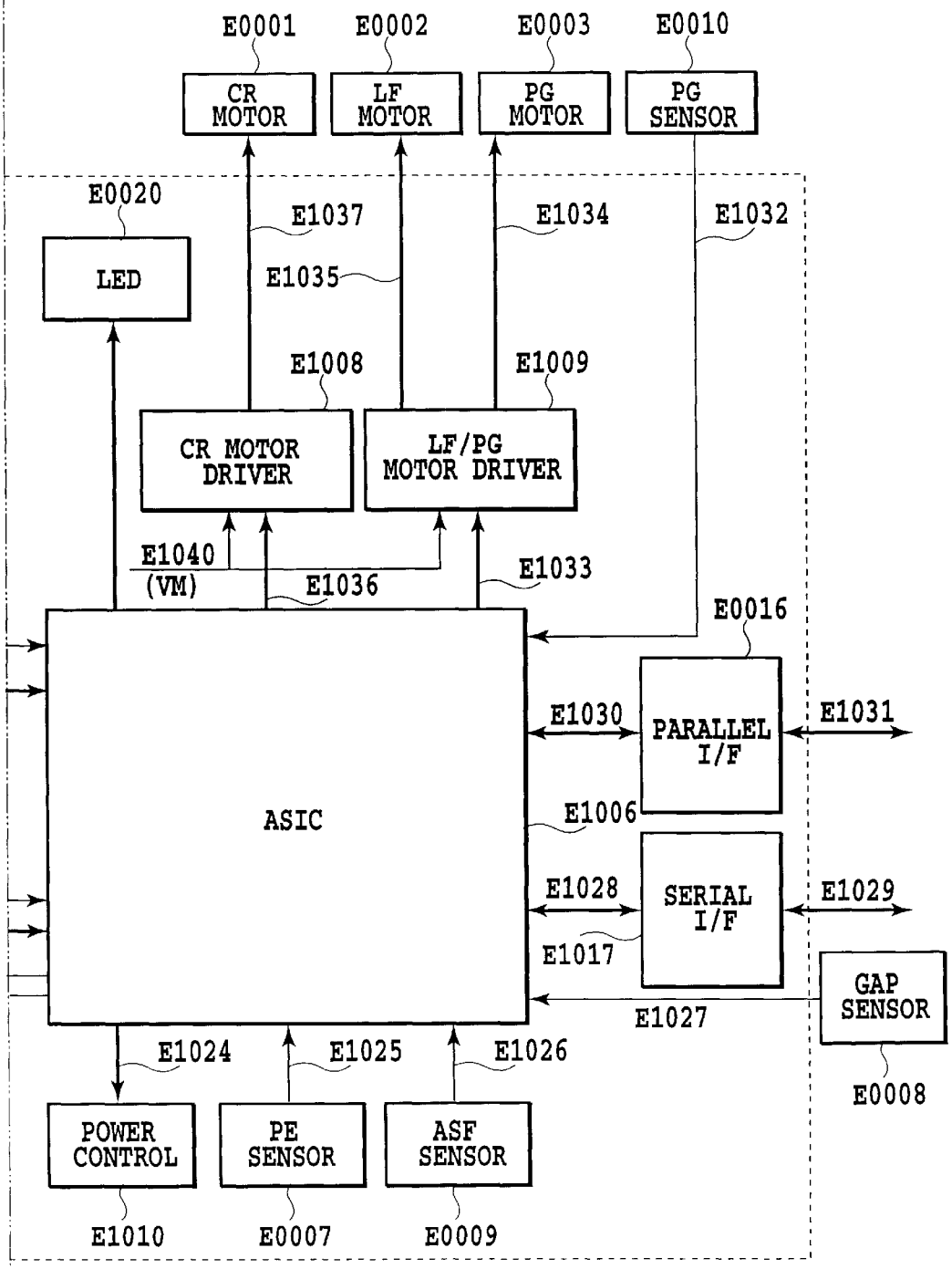

FIG. 8 is a diagram showing the relation between FIGS. 8A and 8B, and FIGS. 8A and 8B are block diagrams showing an inner configuration of the main PCB E0014.

Reference number E1001 represents a CPU, which has a clock generator (CG) E1002 connected to an oscillation circuit E1005 to generate a system clock based on an output signal E1019 of the oscillation circuit E1005. The CPU E1001 is connected to an ASIC (application specific integrated circuit) and a ROM E1004 through a control bus E1014. According to a program stored in the ROM E1004, the CPU E1001 controls the ASIC E1006, checks the status of an input signal E1017 from the power key, an input signal E1016 from the resume key, a cover detection signal E1042 and a head detection signal (HSENS) E1013, drives the buzzer E0021 according to a buzzer signal (BUZ) E1018, and checks the status of an ink empty detection signal (INKS) E1011 connected to a built-in A/D converter E1003 and of a temperature detection signal (TH) E1012 from a thermistor. The CPU E1001 also performs various other logic operations and makes conditional decisions to control the operation of the ink jet printing apparatus.

The head detection signal E1013 is a head mount detection signal entered from the print head cartridge H1000 through the flexible flat cable E0012, the carriage substrate E0013 and the contact FPC E0011. The ink empty detection signal E1011 is an analog signal output from the ink empty sensor E0006. The temperature detection signal E1012 is an analog signal from the thermistor (not shown) provided on the carriage substrate E0013.

Designated E1008 is a CR motor driver that uses a motor power supply (VM) E1040 to generate a CR motor drive signal E1037 according to a CR motor control signal E1036 from the ASIC E1006 to drive the CR motor E0001. E1009 designates an LF/PG motor driver which uses the motor power supply E1040 to generate an LF motor drive signal E1035 according to a pulse motor control signal (PM control signal) E1033 from the ASIC E1006 to drive the LF motor. The LF/PG motor driver E1009 also generates a PG motor drive signal E1034 to drive the PG motor.

E1010 is a power supply control circuit which controls the supply of electricity to respective sensors with light emitting elements according to a power supply control signal E1024 from the ASIC E1006. The parallel I/F E0016 transfers a parallel I/F signal E1030 from the ASIC E1006 to a parallel I/F cable E1031 connected to external circuits and also transfers a signal of the parallel I/F cable E1031 to the ASIC E1006. The serial I/F E0017 transfers a serial I/F signal E1028 from the ASIC E1006 to a serial I/F cable E1029 connected to external circuits, and also transfers a signal from the serial I/F cable E1029 to the ASIC E1006.

The power supply unit E0015 provides a head power signal (VH) E1039, a motor power signal (VM) E1040 and a logic power signal (VDD) E1041. A head power ON signal (VHON) E1022 and a motor power ON signal (VMON) E1023 are sent from the ASIC E1006 to the power supply unit E0015 to perform the ON/OFF control of the head power signal E1039 and the motor power signal E1040. The logic power signal (VDD) E1041 supplied from the power supply unit E0015 is voltage-converted as required and given to various parts inside or outside the main PCB E0014.

The head power signal E1039 is smoothed by the main PCB E0014 and then sent out to the flexible flat cable E0011 to be used for driving the print head cartridge H1000. E1007 denotes a reset circuit which detects a reduction in the logic power signal E1041 and sends a reset signal (RESET) to the CPU E1001 and the ASIC E1006 to initialize them.

The ASIC E1006 is a single-chip semiconductor integrated circuit and is controlled by the CPU E1001 through the control bus E1014 to output the CR motor control signal E1036, the PM control signal E1033, the power supply control signal E1024, the head power ON signal E1022 and the motor power ON signal E1023. It also transfers signals to and from the parallel interface E0016 and the serial interface E0017. In addition, the ASIC E1006 detects the status of a PE detection signal (PES) E1025 from the PE sensor E0007, an ASF detection signal (ASFS) E1026 from the ASF sensor E0009, a gap detection signal (GAPS) E1027 from the GAP sensor E0008 for detecting a gap between the print head and the printing medium, and a PG detection signal (PGS) E1032 from the PE sensor E0007, and sends data representing the statuses of these signals to the CPU E1001 through the control bus E1014. Based on the data received, the CPU E1001 controls the operation of an LED drive signal E1038 to turn on or off the LED E0020.

Further, the ASIC E1006 checks the status of an encoder signal (ENC) E1020, generates a timing signal, interfaces with the print head cartridge H1000 and controls the print operation by a head control signal E1021. The encoder signal (ENC) E1020 is an output signal of the CR encoder sensor E0004 received through the flexible flat cable E0012. The head control signal E1021 is sent to the print head H1001 through the flexible flat cable E0012, carriage substrate E0013 and contact FPC E0011.

Figures 9, 9A:
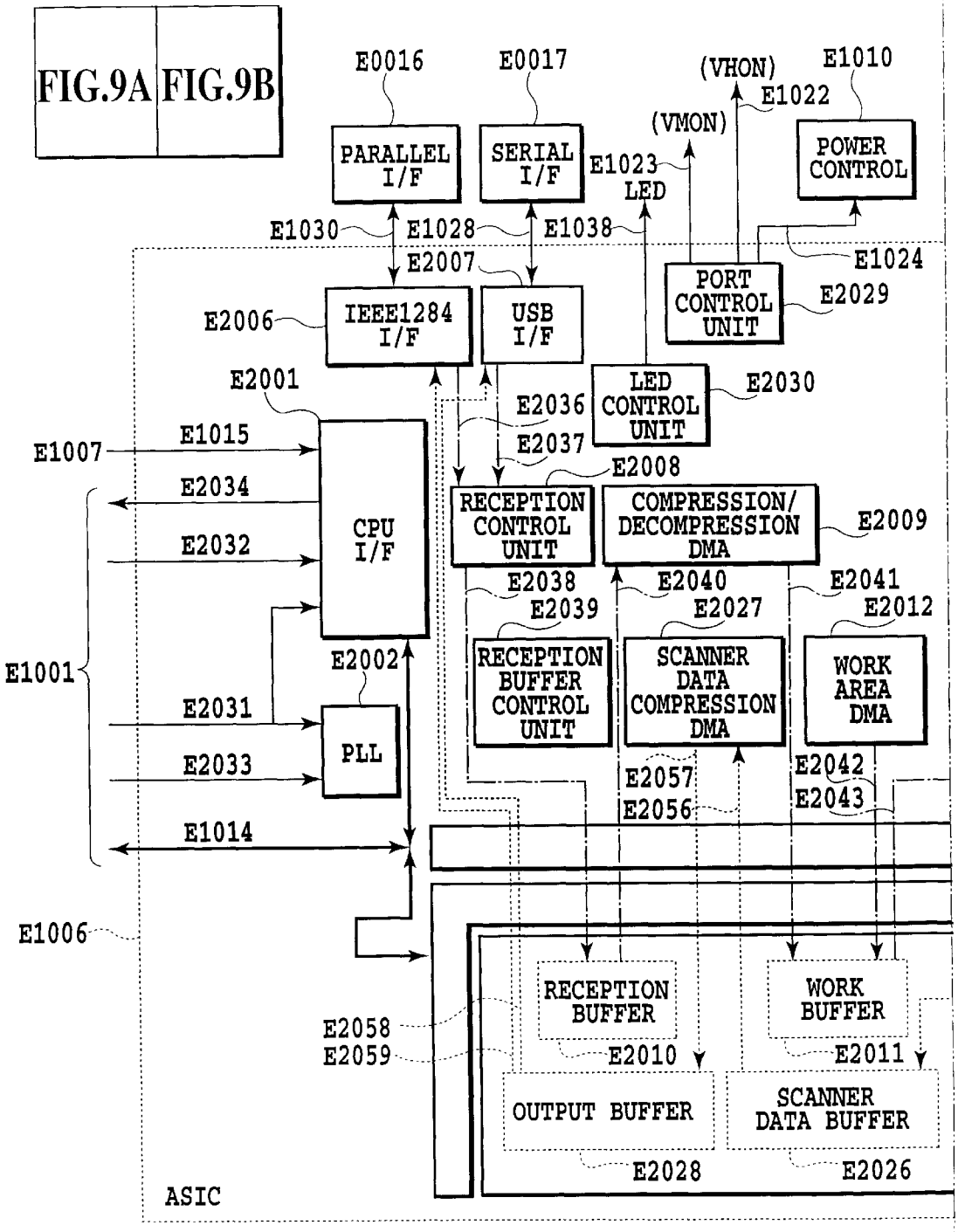
FIG. 9 is a diagram showing the relation between FIGS. 9A and 9B, FIGS. 9A and 9B being block diagrams representing an example inner configuration of an application specific integrated circuit (ASIC) in the main PCB of FIGS. 8A and 8B.
Figure 9B:
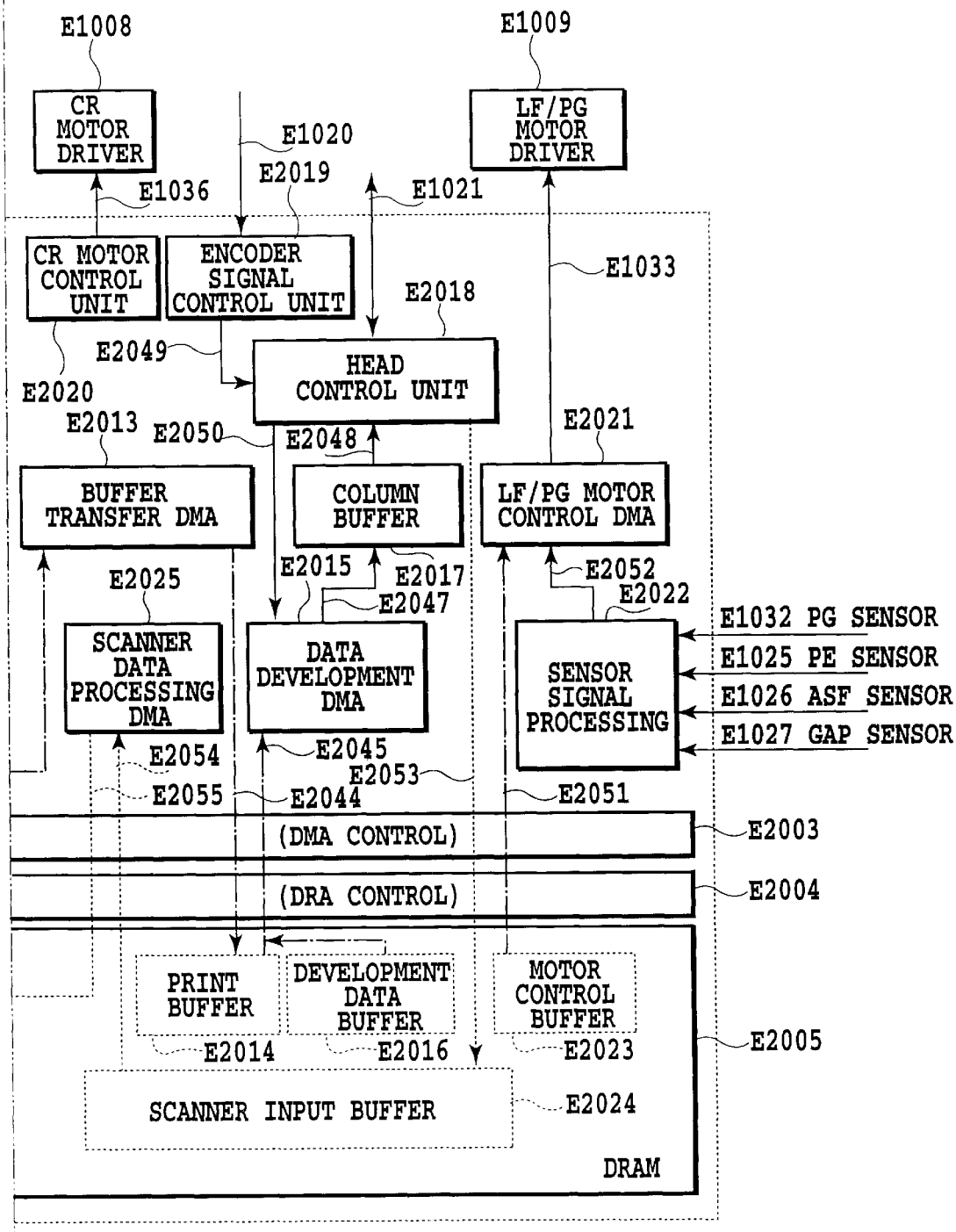

FIG. 9 is a diagram showing the relation between FIGS. 9A and 9B, and FIGS. 9A and 9B are block diagrams showing an example internal configuration of the ASIC E1006.

In these figures, only the flow of data, such as print data and motor control data, associated with the control of the head and various mechanical components is shown between each block, and control signals and clock associated with the read/write operation of the registers incorporated in each block and control signals associated with the DMA control are omitted to simplify the drawing.

In the figures, reference number E2002 represents a PLL controller which, based on a clock signal (CLK) E2031 and a PLL control signal (PLLON) E2033 output from the CPU E1001, generates a clock (not shown) to be supplied to the most part of the ASIC E1006.

Denoted E2001 is a CPU interface (CPU I/F) E2001, which controls the read/write operation of register in each block, supplies a clock to some blocks and accepts an interrupt signal (none of these operations are shown) according to a reset signal E1015, a software reset signal (PDWN) E2032 and a clock signal (CLK) E2031 output from the CPU E1001, and control signals from the control bus E1014. The CPU I/F E2001 then outputs an interrupt signal (INT) E2034 to the CPU E1001 to inform it of the occurrence of an interrupt within the ASIC E1006.

E2005 denotes a DRAM which has various areas for storing print data, such as a reception buffer E2010, a work buffer E2011, a print buffer E2014 and a development data buffer E2016. The DRAM E2005 also has a motor control buffer E2023 for motor control and, as buffers used instead of the above print data buffers during the scanner operation mode, a scanner input buffer E2024, a scanner data buffer E2026 and an output buffer E2028.

The DRAM E2005 is also used as a work area by the CPU E1001 for its own operation. Designated E2004 is a DRAM control unit E2004 which performs read/write operations on the DRAM E2005 by switching between the DRAM access from the CPU E1001 through the control bus and the DRAM access from a DMA control unit E2003 described later.

The DMA control unit E2003 accepts request signals (not shown) from various blocks and outputs address signals and control signals (not shown) and, in the case of write operation, write data E2038, E2041, E2044, E2053, E2055, E2057 etc. to the DRAM control unit to make DRAM accesses. In the case of read operation, the DMA control unit E2003 transfers the read data E2040, E2043, E2045, E2051, E2054, E2056, E2058, E2059 from the DRAM control unit E2004 to the requesting blocks.

Denoted E2006 is a IEEE 1284 I/F which functions as a bi-directional communication interface with external host devices, not shown, through the parallel I/F E0016 and is controlled by the CPU E1001 via CPU I/F E2001. During the printing operation, the IEEE 1284 I/F E2006 transfers the receive data (PIF receive data E2036) from the parallel I/F E0016 to a reception control unit E2008 by the DMA processing. During the scanner reading operation, the 1284 I/F E2006 sends the data (1284 transmit data (RDPIF) E2059) stored in the output buffer E2028 in the DRAM E2005 to the parallel I/F E0016 by the DMA processing.

Designated E2007 is a universal serial bus (USB) I/F which offers a bi-directional communication interface with external host devices, not shown, through the serial I/F E0017 and is controlled by the CPU E1001 through the CPU I/F E2001. During the printing operation, the universal serial bus (USB) I/F E2007 transfers received data (USB receive data E2037) from the serial I/F E0017 to the reception control unit E2008 by the DMA processing. During the scanner reading, the universal serial bus (USB) I/F E2007 sends data (USB transmit data (RDUSB) E2058) stored in the output buffer E2028 in the DRAM E2005 to the serial I/F E0017 by the DMA processing. The reception control unit E2008 writes data (WDIF E2038) received from the 1284 I/F E2006 or universal serial bus (USB) I/F E2007, whichever is selected, into a reception buffer write address managed by a reception buffer control unit E2039.

Designated E2009 is a compression/decompression DMA controller which is controlled by the CPU E1001 through the CPU I/F E2001 to read received data (raster data) stored in a reception buffer E2010 from a reception buffer read address managed by the reception buffer control unit E2039, compress or decompress the data (RDWK) E2040 according to a specified mode, and write the data as a print code string (WDWK) E2041 into the work buffer area.

Designated E2013 is a print buffer transfer DMA controller which is controlled by the CPU E1001 through the CPU I/F E2001 to read print codes (RDWP) E2043 on the work buffer E2011 and rearrange the print codes onto addresses on the print buffer E2014 that match the sequence of data transfer to the print head cartridge H1000 before transferring the codes (WDWP E2044). Reference number E2012 denotes a work area DMA controller which is controlled by the CPU E1001 through the CPU I/F E2001 to repetitively write specified work fill data (WDWF) E2042 into the area of the work buffer whose data transfer by the print buffer transfer DMA controller E2013 has been completed.

Designated E2015 is a print data development DMA controller E2015, which is controlled by the CPU E1001 through the CPU I/F E2001. Triggered by a data development timing signal E2050 from a head control unit E2018, the print data development DMA controller E2015 reads the print code that was rearranged and written into the print buffer and the development data written into the development data buffer E2016 and writes developed print data (RDHDG) E2045 into the column buffer E2017 as column buffer write data (WDHDG) E2047. The column buffer E2017 is an SRAM that temporarily stores the transfer data (developed print data) to be sent to the print head cartridge H1000, and is shared and managed by both the print data development DMA CONTROLLER and the head control unit through a handshake signal (not shown).

Designated E2018 is a head control unit E2018 which is controlled by the CPU E1001 through the CPU I/F E2001 to interface with the print head cartridge H1000 or the scanner through the head control signal. It also outputs a data development timing signal E2050 to the print data development DMA controller according to a head drive timing signal E2049 from the encoder signal processing unit E2019.

During the printing operation, the head control unit E2018, when it receives the head drive timing signal E2049, reads developed print data (RDHD) E2048 from the column buffer and outputs the data to the print head cartridge H1000 as the head control signal E1021.

In the scanner reading mode, the head control unit E2018 DMA-transfers the input data (WDHD) E2053 received as the head control signal E1021 to the scanner input buffer E2024 on the DRAM E2005. Designated E2025 is a scanner data processing DMA controller E2025 which is controlled by the CPU E1001 through the CPU I/F E2001 to read input buffer read data (RDAV) E2054 stored in the scanner input buffer E2024 and writes the averaged data (WDAV) E2055 into the scanner data buffer E2026 on the DRAM E2005.

Designated E2027 is a scanner data compression DMA controller which is controlled by the CPU E1001 through the CPU I/F E2001 to read processed data (RDYC) E2056 on the scanner data buffer E2026, perform data compression, and write the compressed data (WDYC) E2057 into the output buffer E2028 for transfer.

Designated E2019 is an encoder signal processing unit which, when it receives an encoder signal (ENC), outputs the head drive timing signal E2049 according to a mode determined by the CPU E1001. The encoder signal processing unit E2019 also stores in a register information on the position and speed of the carriage M4001 obtained from the encoder signal E1020 and presents it to the CPU E1001. Based on this information, the CPU E1001 determines various parameters for the CR motor E0001. Designated E2020 is a CR motor control unit which is controlled by the CPU E1001 through the CPU I/F E2001 to output the CR motor control signal E1036.

Denoted E2022 is a sensor signal processing unit which receives detection signals E1032, E1025, E1026 and E1027 output from the PG sensor E0010, the PE sensor E0007, the ASF sensor E0009 and the gap sensor E0008, respectively, and transfers these sensor information to the CPU E1001 according to the mode determined by the CPU E1001. The sensor signal processing unit E2022 also outputs a sensor detection signal E2052 to a DMA controller E2021 for controlling LF/PG motor.

The DMA controller E2021 for controlling LF/PG motor is controlled by the CPU E1001 through the CPU I/F E2001 to read a pulse motor drive table (RDPM) E2051 from the motor control buffer E2023 on the DRAM E2005 and output a pulse motor control signal E1033. Depending on the operation mode, the controller outputs the pulse motor control signal E1033 upon reception of the sensor detection signal as a control trigger.

Designated E2030 is an LED control unit which is controlled by the CPU E1001 through the CPU I/F E2001 to output an LED drive signal E1038. Further, designated E2029 is a port control unit which is controlled by the CPU E1001 through the CPU I/F E2001 to output the head power ON signal E1022, the motor power ON signal E1023 and the power supply control signal E1024.

5. Operation of Printer

Figure 10:
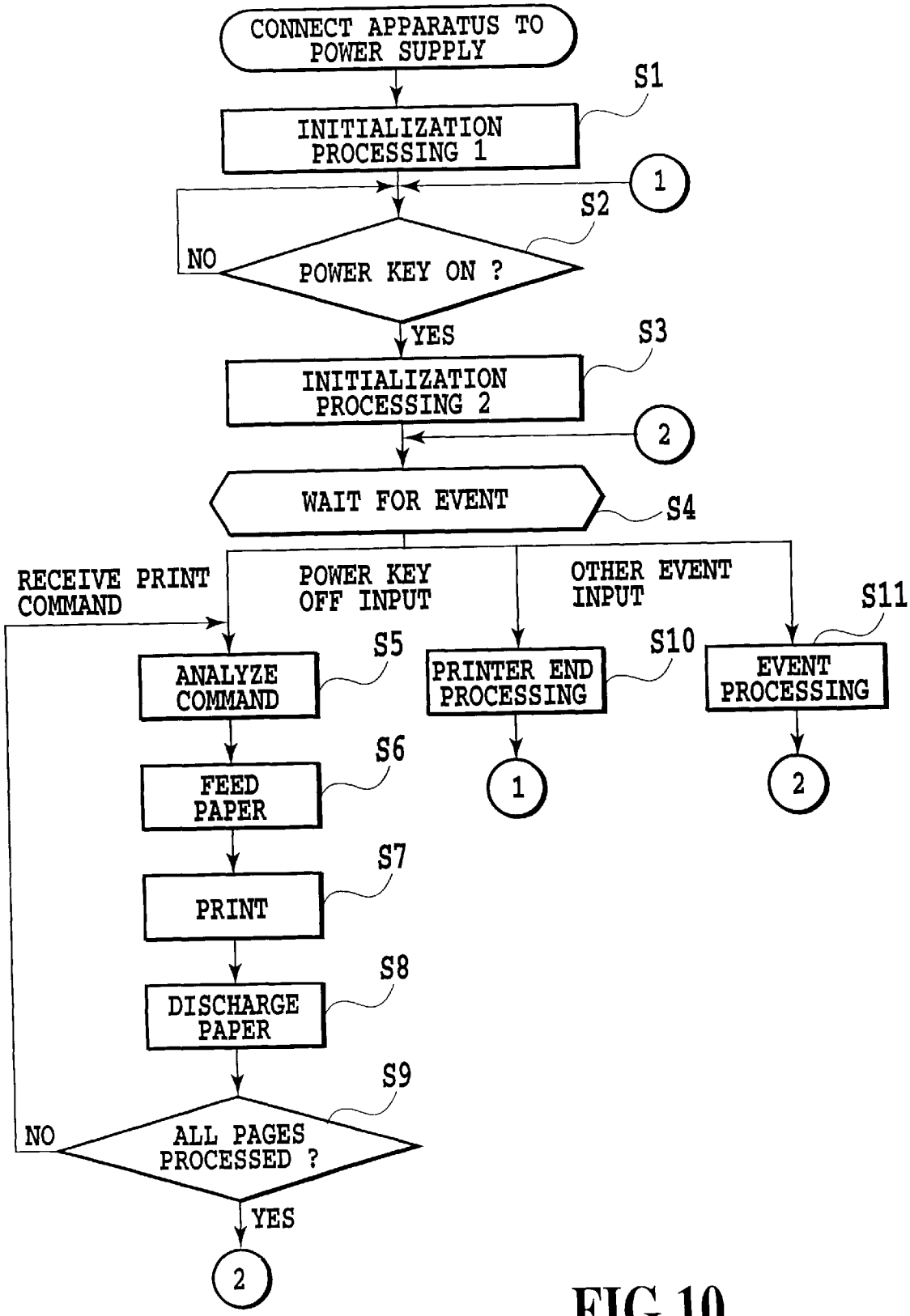
FIG. 10 is a flow chart showing an example of operation of the printer as one embodiment of the present invention.

Next, the operation of the ink jet printing apparatus in this embodiment of the invention with the above configuration will be explained by referring to the flow chart of FIG. 10.

When the printer body M1000 is connected to an AC power supply, a first initialization is performed at step Si. In this initialization process, the electric circuit system including the ROM and RAM in the apparatus is checked to confirm that the apparatus is electrically operable.

Next, step S2 checks if the power key E0018 on the upper case M1002 of the printer body M1000 is turned on. When it is decided that the power key E0018 is pressed, the processing moves to the next step S3 where a second initialization is performed.

In this second initialization, a check is made of various drive mechanisms and the print head of this apparatus. That is, when various motors are initialized and head information is read, it is checked whether the apparatus is normally operable.

Next, steps S4 waits for an event. That is, this step monitors a demand event from the external I/F, a panel key event from the user operation and an internal control event and, when any of these events occurs, executes the corresponding processing.

When, for example, step S4 receives a print command event from the external I/F, the processing moves to step S5. When a power key event from the user operation occurs at step S4, the processing moves to step S10. If another event occurs, the processing moves to step S11.

Step S5 analyzes the print command from the external I/F, checks a specified paper kind, paper size, print quality, paper feeding method and others, and stores data representing the check result into the DRAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the printhead H1001 to print one line. When one line of the print data has been printed, the LF motor E0002 is driven to rotate the LF roller M3001 to transport the paper in the sub-scanning direction. After this, the above operation is executed repetitively until one page of the print data from the external I/F is completely printed, at which time the processing moves to step S8.

At step S8, the LF motor E0002 is driven to rotate the paper discharge roller M2003 to feed the paper until it is decided that the paper is completely fed out of the apparatus, at which time the paper is completely discharged onto the paper discharge tray M1004*a*.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step performs processing corresponding to the ejection performance recovery command from various panel keys or external I/F and the ejection performance recovery event that occurs internally. After the recovery processing is finished, the printer operation moves to step S4 waiting for the next event.

First Embodiment

A first embodiment of an ink jet print head in the above described ink jet printing apparatus will be explained below.

Figure 23:
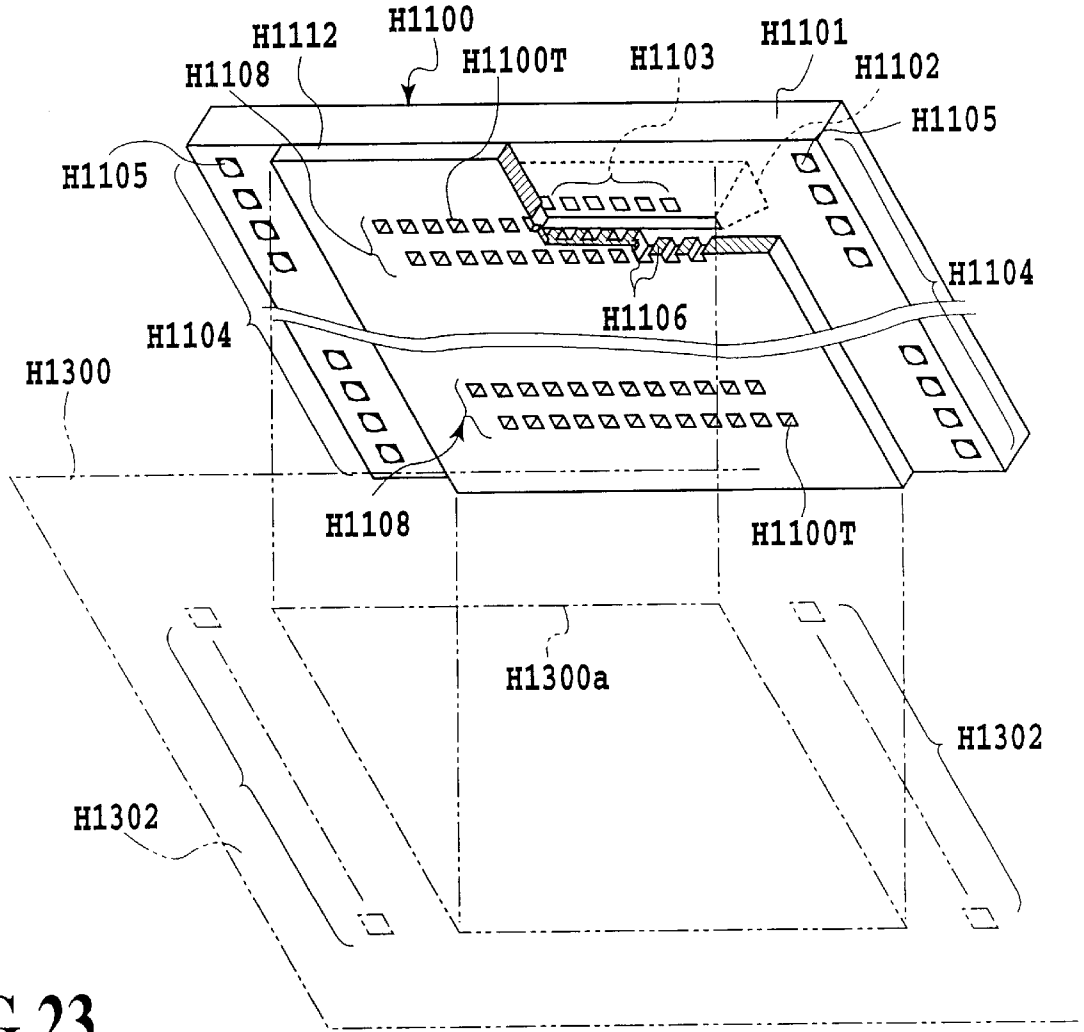
FIG. 23 is a partly broken perspective view showing a main part of a printing head according to an embodiment of the present invention.

FIG. 23 is a partially exploded perspective view for explaining the constitution of the print element substrate H1100.

In the print element substrate H1100, a plurality of print elements, a plurality of ink flow passages and a plurality of ejection openings H1100T corresponding to these print elements are formed by a photo-lithographic technology, and ink supply ports open on the back surface of the substrate. The print element substrate H1100 is, for example, of a side shooter type and constituted by a single substrate. In this substrate, the plurality of ejection openings H1100T arranged in two rows in a zigzag manner are formed at approximately 1200 dpi for the individual color, and ejecting different colored ink respectively. A preferable ejection method used for the present invention is a method such that, as shown in FIGS. 24A–24H, a bubble 301 generated by thermal energy caused by an electro-thermal converting element 13 communicates with an atmospheric air and then an ink droplet is ejected from an ejection opening 11. The method is so called "bubble through jet method."

The print element substrate H1100 consists, for example, of an Si substrate H1101 with a thin film formed on the surface thereof and an orifice plate H1112 formed on the substrate H1101, as shown in FIG. 23.

For example, the substrate 1101 has a thickness in a range from 0.5 to 1 (mm), and six rows of ink supply ports 1102 in a form of an elongate groove-like through-hole are integrally formed in parallel to each other as flow passages for six color inks. A mutual distance between the ink supply ports H1102 adjacent to each other is, for example, about 2.5 (mm). Since the mutual distance is relatively small, it is possible to design the print head small in size. On each of opposite sides of the respective ink supply port H1102, a row of electro-thermal transducer elements H1103 used as print elements for the individual colored ink are arranged in a zigzag manner relative to those in another side row, for example, at approximately 1200 dpi.

Electric wiring (not shown in FIG. 23) of aluminum or others for supplying electric power to the plurality of electro-thermal transducer element H1103 provided in the substrate H1101 and to the respective electro-thermal transducer elements H1103 may be formed by a film deposition technology. Also, an electrode section H1104 for supplying electric power to the electric wiring is formed along each of opposite edges defined in the direction vertical to the arrangement direction of the electro-thermal transducer elements H1103. In the electrode section H1104, a plurality of bumps H1105 of gold or the like are arranged in correspondence to electrode terminals H1302 in the above-mentioned electric wiring board H1300.

The ink supply port H1102 is formed, for example, by an anisotropic etching method while using crystal face orientation of the Si substrate H1101. If the crystal face orientation is <100> along the wafer surface and <111> in the thickness direction, the etching proceeds at an angle of approximately 54.7 degrees(a rising interior angle of face being etched) by the anisotropic etching method using alkaline series (such as KOH, TMAH or hydrazine).

The ink supply port H1102 is formed by etching the substrate at a desired depth according to this method.

As shown in FIG. 23, in the orifice plate H1112 formed on the substrate H1101, an ink flow passage wall H1106 for forming the ink flow passages and the ejection openings H1100T in correspondence to the respective electro-thermal transducer elements H1103 is formed by a photolithographic technology. Accordingly, the ejection openings 1000T adjacent to each other are partitioned by the ink flow passage wall H1106.

The six rows of ejection openings H100T corresponding to the individual six color inks supplied from the respective ink supply ports H1102 are integrally formed in a single orifice plate H1105. The plurality of ejection openings H1100T in the respective row are arranged, for example, at approximately 1200 dpi for every individual colored ink in a zigzag manner similar to the arrangement of the electro-thermal transducer elements H1103.namely, ejection openings H1100T is provided as opposed to the electro-thermal transducer elements H1103.

Accordingly since the rows of electro-thermal transducer elements H1103 and ejection openings H1100T are formed on the same print element substrate H1100 so that the six kinds of ink can be ejected, it is possible to design the print element substrate H1100 to be smaller in size than in the prior art wherein a row of ejection openings for the respective ink is separately provided.

Figure 16A:
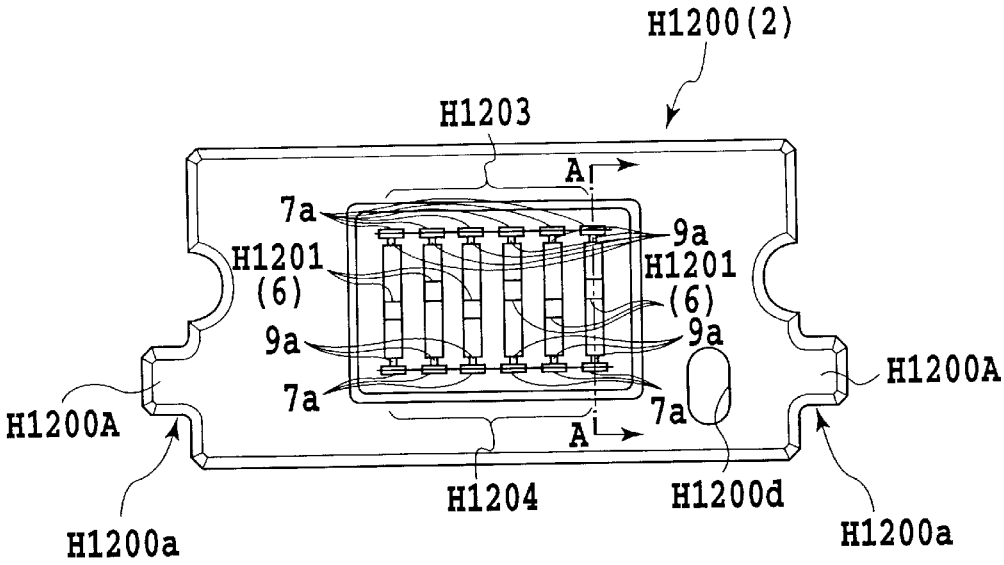
FIG. 16A is directed to a modification of the second embodiment and is plan view showing a main structure of a print head for a plurality of kinds of inks.

The first plate H1200 shown in FIG. 16A is made, for example, of alumina ($Al_2O_3$) to have a thickness in a range from 0.5 to 10 (mm). It should be noted that material for the first plate is not limited to alumina but may be any of materials provided it has a linear thermal expansion coefficient equal to that of material for the print element substrate H1100 as well as a thermal conductivity equal to that of material for the print element substrate H1100 or more. Material for the first plate H1200 may be any one of silicon (Si), aluminum nitride (AlN), zirconia, silicon nitride ($Si_3N_4$), silicon carbide (SiC), molybdenum (Mo) and tungsten (W). The first plate H1200 is provided with six ink supply ports H1201 for supplying six colored inks to the print element substrate H1100. The six ink supply ports are arranged in a zigzag manner. Six ink supply ports H1102 of the print element substrate H1100 are positioned in correspondence to the six ink supply ports H1201 of the first plate H1200, respectively, and the print element substrate H1100 is fixedly adhered to the first plate H1200 at a high positional accuracy. A first adhesive H1204 used for the adhesion is coated on the first plate H1200 generally in a shape of the print element substrate while taking care not to generate air path between the ink supply ports adjacent to each other. The first adhesive H1204 preferably has a relatively low viscosity capable of forming a thin adhesive layer on a contact surface, a relatively high hardness after being cured, and a high resistance to ink. The first adhesive H1204 is, for example, a heat-hardening adhesive mainly composed of epoxy resin, and a thickness of the adhesive layer is preferably 50 ($\mu$m) or less.

Figure 24A:
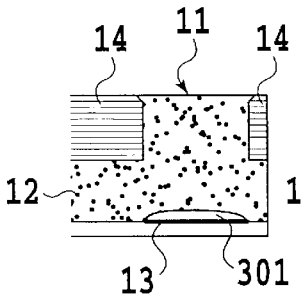
FIGS. 24A, 24B, 24C, 24D, 24E, 24F, 24G and 24H are sectional views for explaining a serial ink ejection state by a bubble through jet method.
Figure 24B:
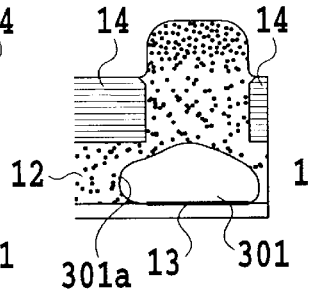
Figure 24C:
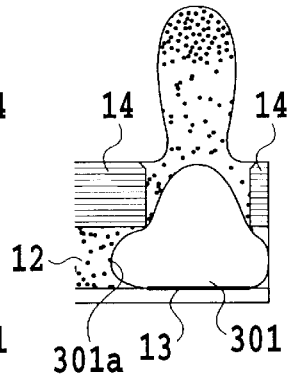
Figure 24D:
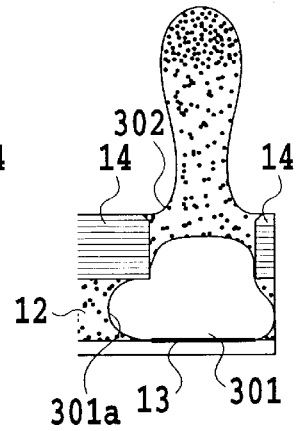
Figure 24E:
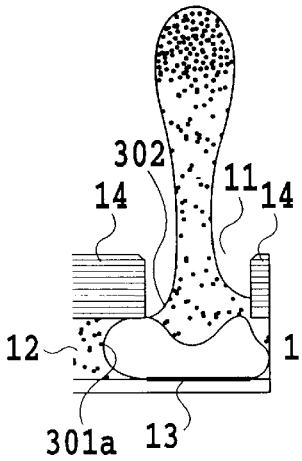
Figure 24F:
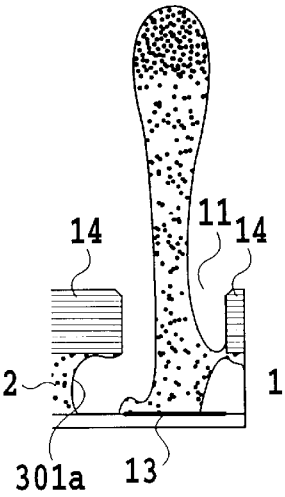
Figure 24G:
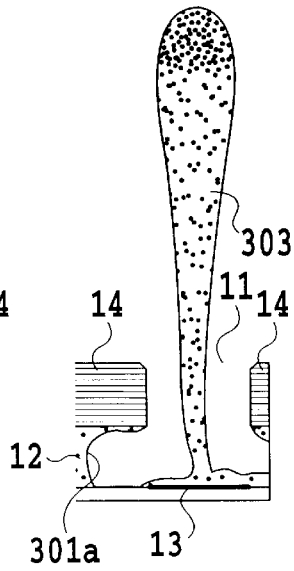

As shown in FIGS. 24A, the first plate H1200 has protrusion H1200A at opposite ends thereof, respectively. The protrusion H1200A has an engagement surface H1200*a* as a reference surface for engaging with the above-mentioned reference end surfaces H1502*a* and 1502*b*, respectively. The protrusion H1200A extends from the lateral side of the plate generally in the vertical direction, i.e., in the moving direction of the tank holder H1500. Also, an aperture H1200*d* engageable with a tip end of a positioning pin IP of the tank holder H1500 is formed at a position corresponding to the positioning pin IP.

Figure 16B:
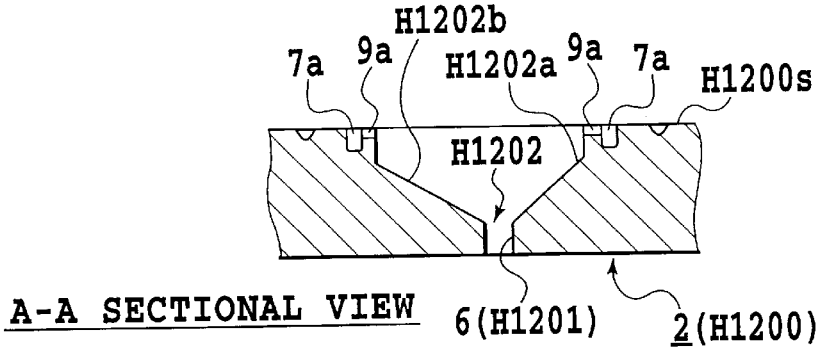
FIGS. 16B and 16C are sectional views thereof.
Figure 16C:
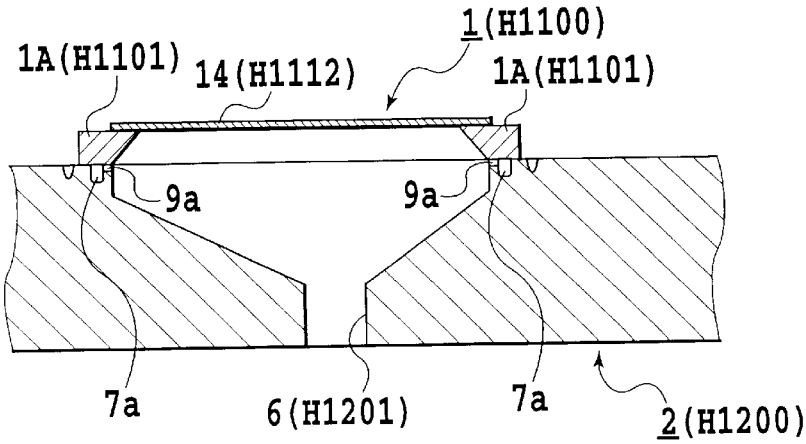

The respective ink supply port H1201 communicates with an enlarged portion H1202 defining an ink flow passage opened to an end surface H1200*s* to which is adhered the print element substrate H1100, as shown in FIGS. 16B and 16C. The enlarged portion H1202 forming an elongate groove is defined by oppositely formed slants H1202*a* and H1202*b* so that the cross-sectional area enlarges as going to the end surface to which is adhered the print element substrate H1100.

Figure 11:
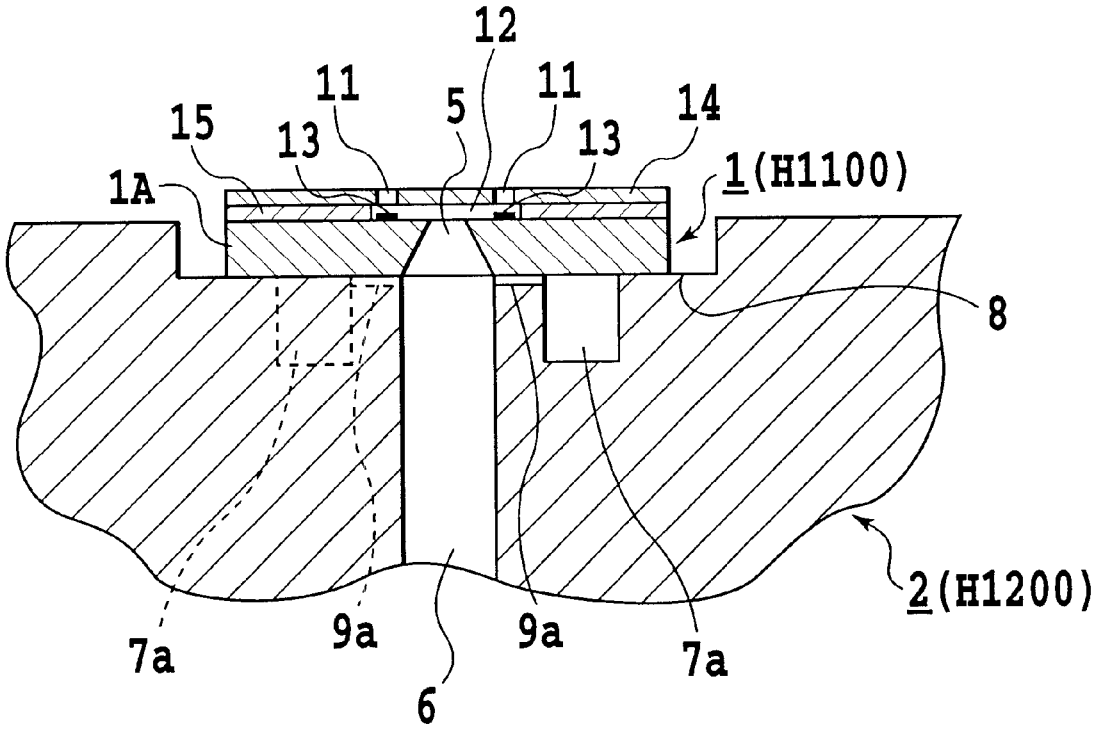
FIG. 11 is a sectional view showing a structure of a main part of a print head according to a first embodiment of the preset invention.

FIG. 11 is a sectional view of a main part of an ink jet print head according to the first embodiment of the present invention as seen from a side relative to an ejection direction. In addition, FIG. 12A is a sectional view of the main part with a print element substrate omitted, as seen from above in the ejection direction. This main part corresponds to the print element substrate H1100 and the first plate H1200 described above for FIG. 5. FIGS. 11 and 12A show a part of the print head which ejects one type of ink. In the following description, reference numerals different from those shown in FIG. 5 will be used.

A print element substrate 1 (H1100) has a substrate body 1A consists of a silicon and electro-thermal conversion elements 13 as a ejection energy generator are formed on the substrate body 1A correspondingly to ejection openings 11, respectively. The substrate body 1A is further formed with electrode wiring thereon for supplying power to the electro-thermal conversion elements and also is formed thereon with an orifice plate 14 in which the ejection openings are formed and a partition wall 15 for partitioning the ejection openings 11 and the liquid paths 12. In the above description for FIG. 5 and other figures, the substrate body 1A and the orifice plate 14 and the partition wall 15 formed on the substrate body 1A are explained as an integral component, that is, the print element substrate H1100. The print element substrate 1 (H1100) is bonded and fixed to a support member 2 (the first plate H1200) which is formed thereon with an ink supply path 6 (the ink supply opening H1201) communicating with an ink supply opening 5 in the print element substrate 1 (H1100). In the above configuration, the ink supply path 6 and the ink supply opening 5 constitute an ink supply chamber for a plurality of ejection openings. The ink supply path 6 shown in FIGS. 11 and 12A corresponds to the ink supply opening H1201 described above for FIG. 5 but is shaped like a slot, different from the circular ink supply opening shown in FIG. 5. The circular ink supply path is used in the embodiment shown in FIG. 18 and other figures as described below.

More specifically, the print element substrate 1 on a silicon wafer constituting the substrate body 1A is provided with a heating resistor layer constituting the electro-thermal conversion element 13, electrode wiring for supplying power to the electro-thermal conversion element, and the like, as patterns formed by means of the photolithography technique. In addition, the orifice plate 14 and the partition wall 15 are formed of a photosensitive resin. Furthermore, the print element substrate 1 has the ink supply opening 5 formed therein by applying anisotropic etching to the silicon wafer and has its external shape formed by means of cutting. The print element substrate 1 is connected by means of the TAB (Tape Automated Bonding) connecting technique to the electric wiring board H1300 described above for FIG. 5 and other figures, in order to apply to each electro-thermal conversion element a voltage pulse depending on a printing signal. The print element substrate 1 is fixedly bonded to the support member 2 through accurate positioning, and an adhesive used for this binding is desirably very viscous so as not to flow to the ink supply path 6 or the ink supply opening 5.

According to this embodiment, in the above configuration of the print head, recesses for air chambers are formed in portions of the support member 2 which is bonded to the print element substrate 1. That is, pressure waves propagating from each liquid path upon ink ejection are absorbed by these air chambers to solve the above described problem with respect to the refill of ink.

As is apparent from FIG. 12A, recesses 7*a* are each formed in a fashion corresponding to a predetermined number of ink ejection openings, and in addition to the recesses 7*a*, connection grooves 9*a* are each formed in a bonding and fixing surface 8 of the support member 2 in a fashion corresponding to one of the recesses. Thus, when the print element substrate 1 is connected to the support member 2 during a print head manufacturing process, a back surface of the print element substrate 1 and the recesses and grooves formed in the bonding and fixing surface 8 of the support member 2 form air chambers (7*a*) and communication paths (9*a*).

According to such a configuration of the air chambers, a pressure caused when the ink is ejected from the ejection opening 11 is transmitted to the ink supply path 6 via the ink supply opening 5, but propagates, as a change in air pressure, to the air chamber 7*a* mainly via the communication path 9*a* that corresponds to the ejection openings. This variation in pressure having a relatively high pressure value has its value reduced in the air chamber 7*a*, which has a larger volume than the communication path 9*a*. That is, the variation in ink pressure caused upon ink ejection can be absorbed by the air chamber 7*a* to reduce adverse effects on the subsequent refill. Thereby, the ejection period need not be determined taking the refill time into consideration as described above. As a result, enabling the print head to be driven at a relatively high speed. In addition, since the air chambers are structured to be closed with respect to the atmosphere, the above described various problems such as the increase in ink viscosity as occurring in the conventional pressure-absorbing structure can be prevented.

Although, in the above description, the air chamber is provided in a fashion corresponding to the predetermined number of ink ejection openings and mainly absorb the variation in pressure caused by ejection from the corresponding ejection openings, of course the present invention is not limited to this configuration but is applicable to other structures. Each air chamber may be formed in a fashion corresponding to each one of the ejection openings and may be configured to effect such a pressure-absorbing action as to absorb ejection pressures from ejection openings that do not correspond to the disposed position of this air chamber.

In other words, in the structure of the air chamber in this embodiment, the air chamber 7*a* requires a sufficient volume to absorb the pressure upon ejection without entry of the ink, and the communication path 9*a* requires a sufficient volume (flow resistance) or capillary force to prevent the ink from being guided into the air chamber 7*a* while guiding a sufficient amount of pressure into the air chamber upon ejection. Thus, in this embodiment, when driving the print head with the ejection amount 15Pl and with 256 ejection openings at a frequency 10 kHz, the air chamber is structured so that A=1.5 mm, B=0.4 mm, C=0.4 mm, D=0.4 mm, E=0.2 mm, and F=0.8 mm, as shown in FIGS. 12A and 12B, thereby sufficiently providing the above described effects.

Figure 13:
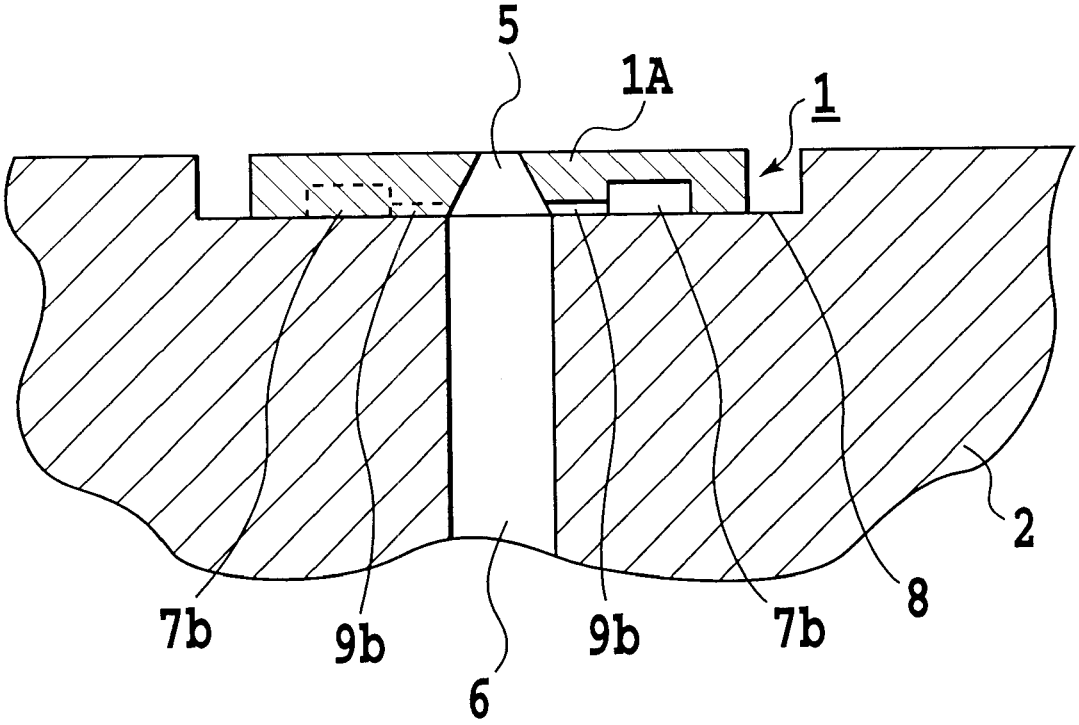
FIG. 13 is a sectional view showing a structure of a main part of a print head according to a modification of the first embodiment.

In this embodiment, similar effects can be obtained by forming similar air chambers 7*b* and communication paths 9*b* in the rear surface of the print element substrate 1 as shown in FIG. 13, instead of the structure shown in FIGS. 11 and FIGS. 12A to 12C. In this case, the grooves for the air chambers can be formed in the print element substrate by means of anisotropic etching or the like. In FIG. 13, illustration of the orifice plates, the partition walls, and other components is omitted.

In addition to the above described effects, the configuration of the air chamber according to this embodiment enables the air chambers and other components can be formed by forming the recesses for the air chambers in either the support member or the print element substrate and then joining the member to the other member, thereby enabling the air chambers and other components to be formed easily.

Figure 14:
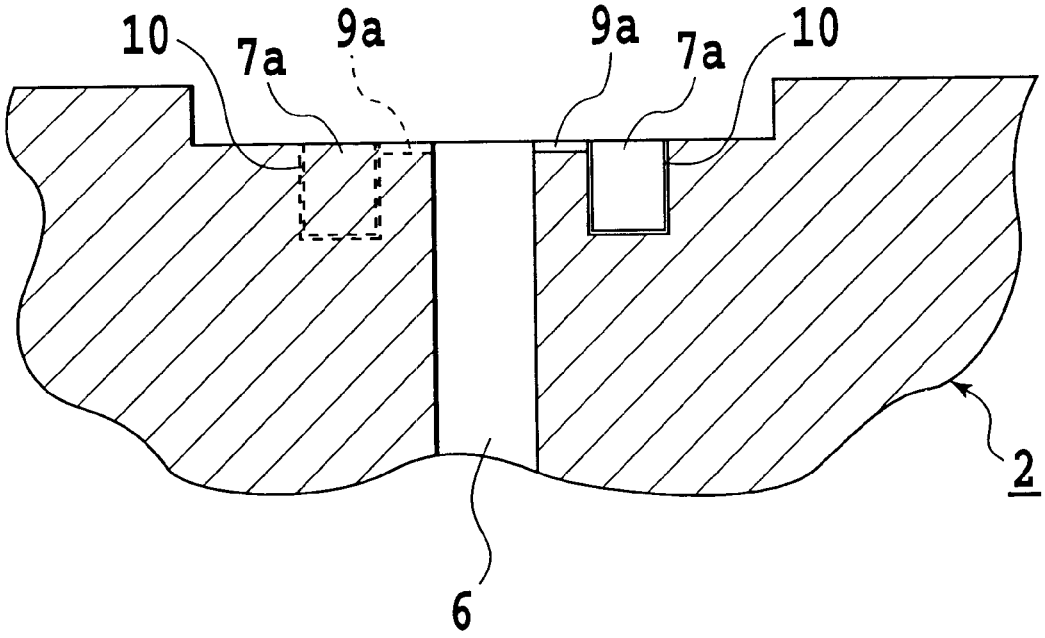
FIG. 14 is a sectional view showing a structure of a main part of a print head according to another modification of the first embodiment.

Furthermore, as shown in FIG. 14, a water-repellent agent may be applied to each wall of the groove 7*a* (7*b*) forming the air chamber, to form a water-repellent layer 10. This configuration, in combination with the effect of the shape of the communication path 9*a* (9*b*), can further appropriately prevent the ink from entering the air chamber.

Second Embodiment

Figure 15A:
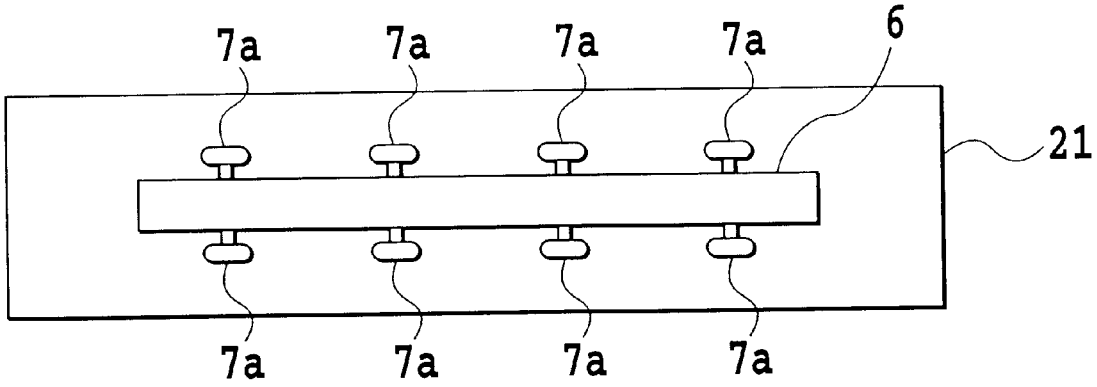
FIGS. 15A and 15B are sectional views showing a structure of a main part of a print head according to a second embodiment of the present invention as seen from an ejection opening side and from a lateral direction relative to the ejection opening side, respectively.
Figure 15B:
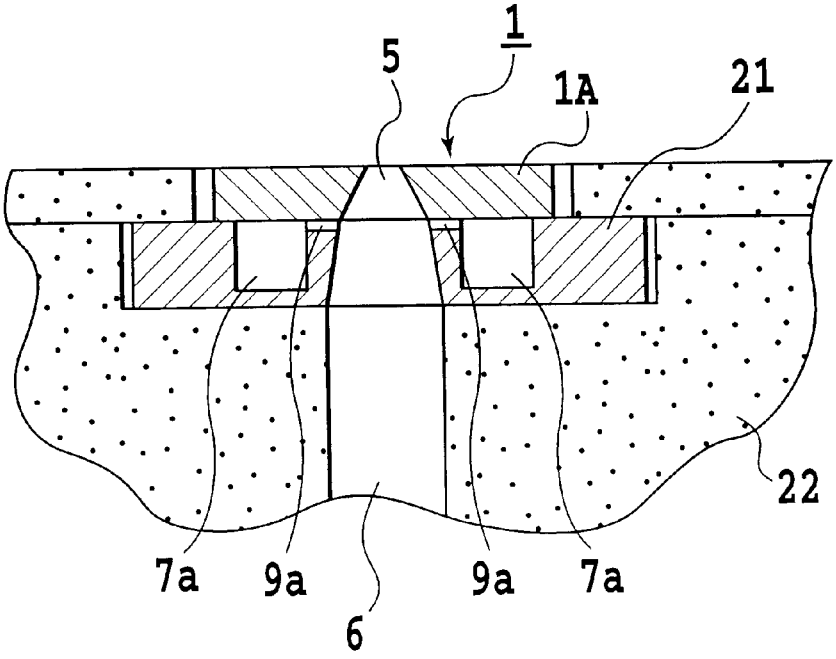

In this embodiment, the present invention is applied to a print head including as a support member two support members, a first support member and a second support member. FIGS. 15A and 15B are sectional views showing a main part of a print head according to this embodiment as seen from an ejection direction and from a side relative to the ejection direction, respectively.

As shown in these figures, the print head according to this embodiment includes as the support member a first support member 21 that fixedly supports the print element substrate 1 and has an ink supply path, and a second support member 22 that fixedly supports the first support member 21 and is provided with the ink supply path 6 for supplying the ink to the print element substrate 1. The first support member 21 is a member that directly connected to the substrate body 1A constituting the print element substrate 1 and is of a material such as silicon, alumina, aluminum nitride, or silicon carbide due to their thermal conductivity, ink resistance, strength, and the like.

Similarly to the first embodiment, the recesses 7*a* and grooves 9*a* for the air chambers and communication paths, respectively, are formed in a portion of the first support member 21 which is bonded to the print element substrate 1. Thus, the air chambers 7*a* and other components are formed when the print element substrate 1 is connected to the first support member 21.

A modification of this embodiment which has the recesses and other components formed in the first support member is shown in FIGS. 16A, 16B and 16C. The structure shown in these figures has a pair of air chambers 7*a* as a unit which is formed correspondingly to each of six kinds of inks. More specifically, FIG. 16A shows a support member 2 as seen from the above it, FIG. 16B shows section with respect to a line A-A shown in FIG. 16A and FIG. 16C shows a connected state of a print element substrate 1 to the support member 2 as a section. A structure shown in these figures differs from a structure that two or more air chambers are provided along an array of electro-thermal conversion elements for a head structure of each kind of ink, but has only two air chambers for each kind of ink. As shown in FIG. 16A, respective one recess 7*a* and respective one groove 9*a* at both ends of the array of electro-thermal conversion elements are formed for each kind of ink. More over, apparent from FIG. 16A and the A—A section shown in FIG. 16B, a shape of the ink supply path 6 differs from that described for the above embodiments but is such that a opening area of the path is made broader at nearer to a connection portion to the print element substrate. This broaden shape allows the ink supply path to cover respective ink paths and to supply the respective kinds of inks to them which correspond to a plurality of electro-thermal conversion elements arranged in the head structure for the respective kinds of inks.

To the support member 2 described above the print element substrate 1 is connected so that the air chamber (7*a*) and communicating path (9*a*) is formed in a sealed condition against the atmosphere and the pressure waves caused upon ink ejection in the print element substrate 1 are absorbed by the air chamber.

The head structure of this embodiment in which the respective air chambers are provided at the respective ends of the array of electro-thermal conversion elements allows pitches between head structures for respective kinds of inks, which are arranged in a line, to be small. This on the other hand allows the print head to be small. More over, the air chamber of this embodiment is positioned at farthest point from the ink supply path. The farthest position is a position where the pressure waves are relatively difficult to be absorbed, and thus providing the air chamber at this position enables the air chamber to function its effect at maximum, as described later referring to FIGS. 22A–22E.

Figure 17A:
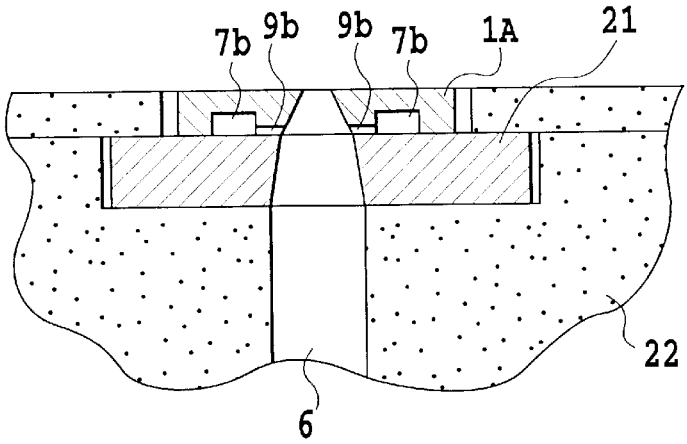
FIGS. 17A, 17B and 17C are sectional views each showing a structure of a main part of a print head according to a modification of the second embodiment.
Figure 17B:
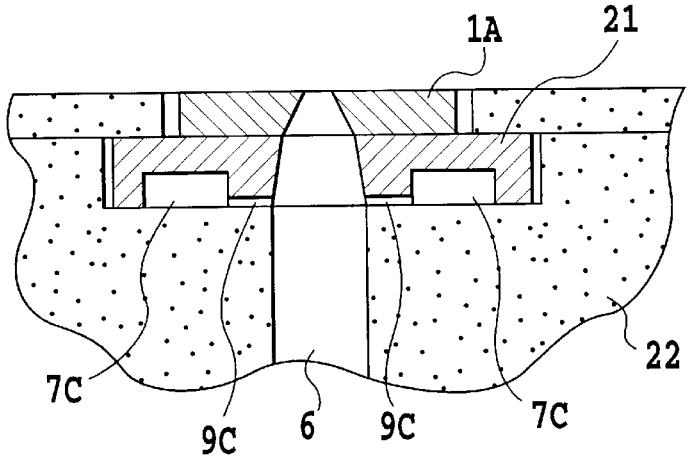
Figure 17C:
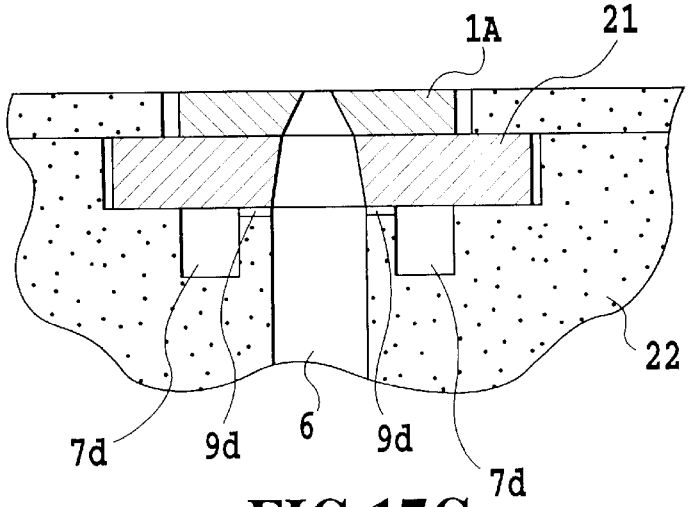

FIGS. 17A, 17B and 17C are views showing other structures. FIG. 17A relates to a structure wherein the recesses 7*b* and the connection grooves 9*b* are formed on the back side of the print element substrate 1 as in the first embodiment. Additionally, FIGS. 17B and 17C relate to structures in which the first support member 21 and the second support member 22 form the air chambers and other components: in FIG. 17B, the recesses and the grooves are formed in the first support member, while, in FIG. 17C, the recesses and the grooves are formed in the second support member.

These structures of the air chambers and other components can provide effects similar to those described in the first embodiment. In addition, each wall of the air chamber may be subjected to a water-repellency-applying process to further prevent the ink from entering the air chamber.

As described above, various forms are possible for the positions at which the air chambers or other components are formed, but a plurality of air chambers or other components disposed at different positions may be combined together to provide larger effects on refill.

Third Embodiment

This embodiment relates to a configuration having recesses formed in part of a surface of the first support member which is connected to the substrate body 1A to form a liquid chamber with the ink supply opening 5 of the print element substrate 1, thereby absorbing pressures originating from ink ejection.

Figure 18A:
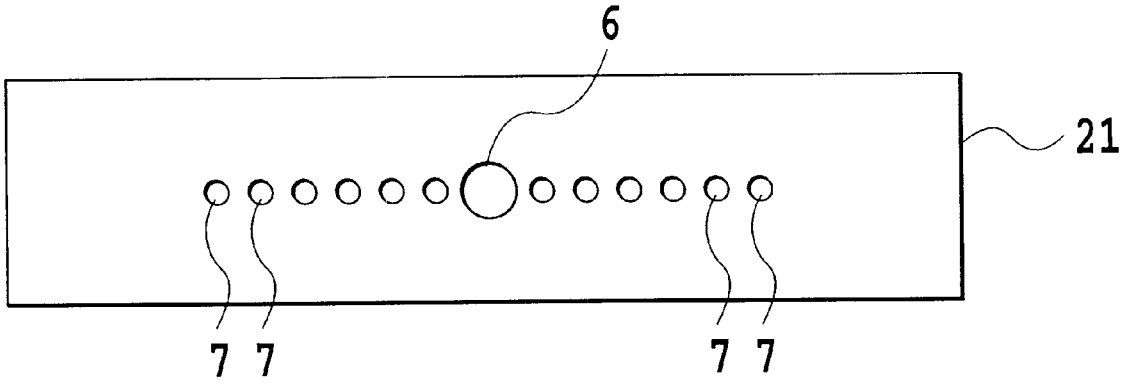
FIGS. 18A and 18B are sectional views showing a structure of a main part of a print head according to a third embodiment of the present invention as seen from an ejection opening side and from a lateral direction relative to the ejection opening side, respectively.
Figure 18B:
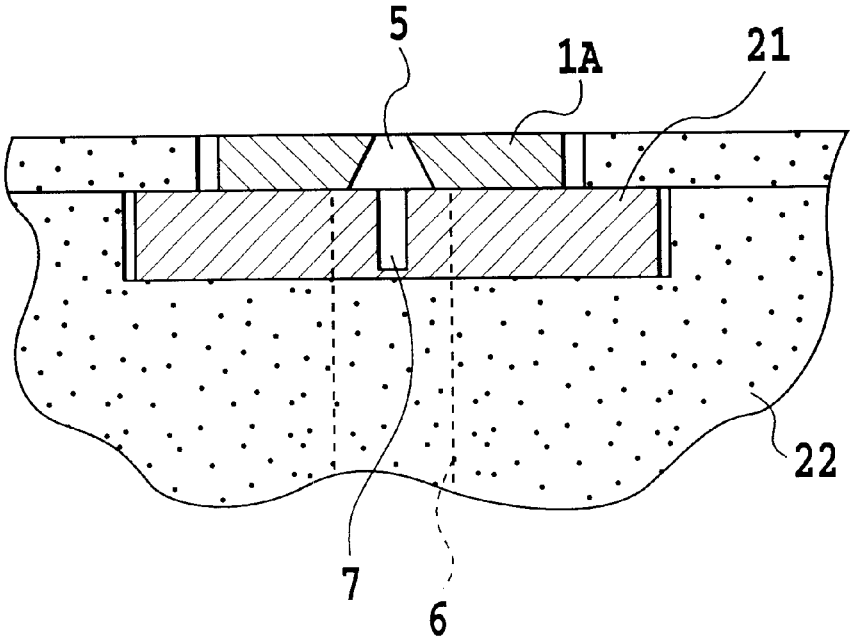

That is, in this embodiment, the ink supply path 6 formed in the support member is not shaped like a slot as in the ink supply opening 5 in the print element substrate but like a cylinder formed in a fashion corresponding to a substantially central portion of the ink supply opening 5, as shown in FIGS. 18A and 18B. Thus, the ink supply opening 5 is in the form of an elongated liquid chamber extending along the arrangement of the ejection openings. The ink is supplied to this liquid chamber via the ink supply path 6, which is in communication with the liquid chamber at its central portion.

In this configuration, a surface of the first support member 21 which is connected to the substrate body 1A of the print element substrate 1 and in which the ink supply opening 5 shaped like the liquid chamber is formed has a plurality of recesses 7 formed therein along the arrangement of the ejection openings (not shown). Of course, the recesses 7 are shaped to prevent entry of the ink from the ink supply path 5 as in the first and second embodiments. In this case, the recesses 7 are desirably as deep as possible. That is, the recesses 7 hold the ink when the capillary force and the like have been appropriately set as in the above described embodiments, and air is constrained deep inside the recesses 7 by means of the held ink, thereby constituting the air chambers.

Figure 19:
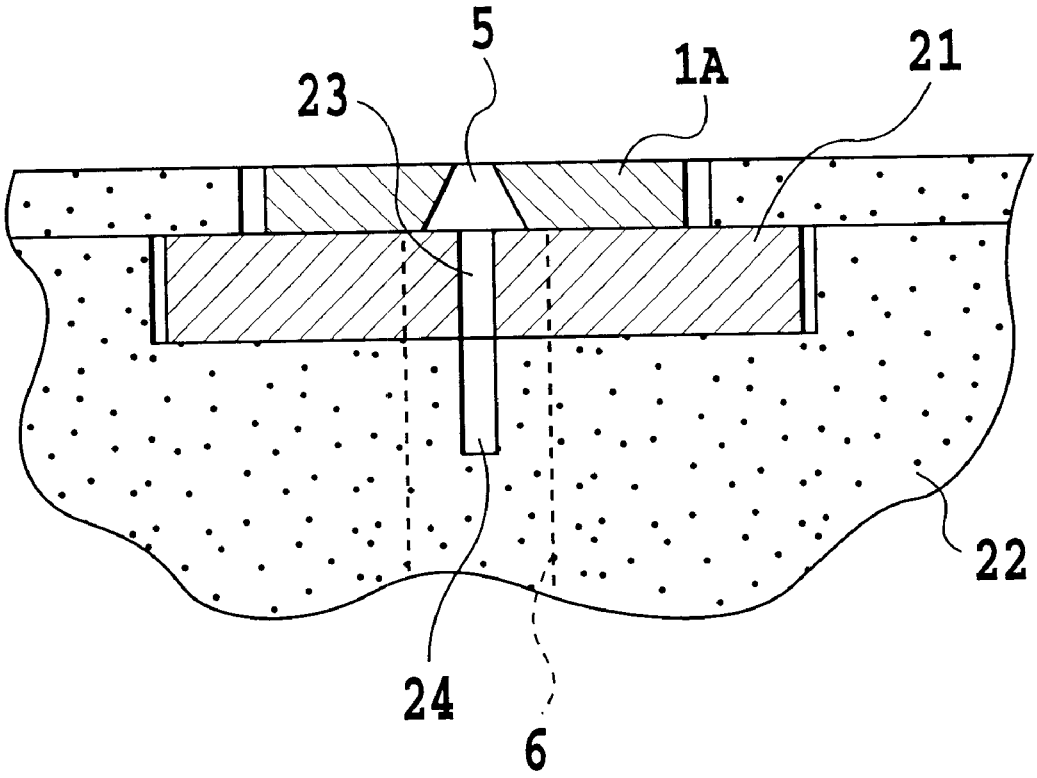
FIG. 19 is a sectional view showing a structure of a main part of a print head according to a modification of the third embodiment.
Figure 20A:
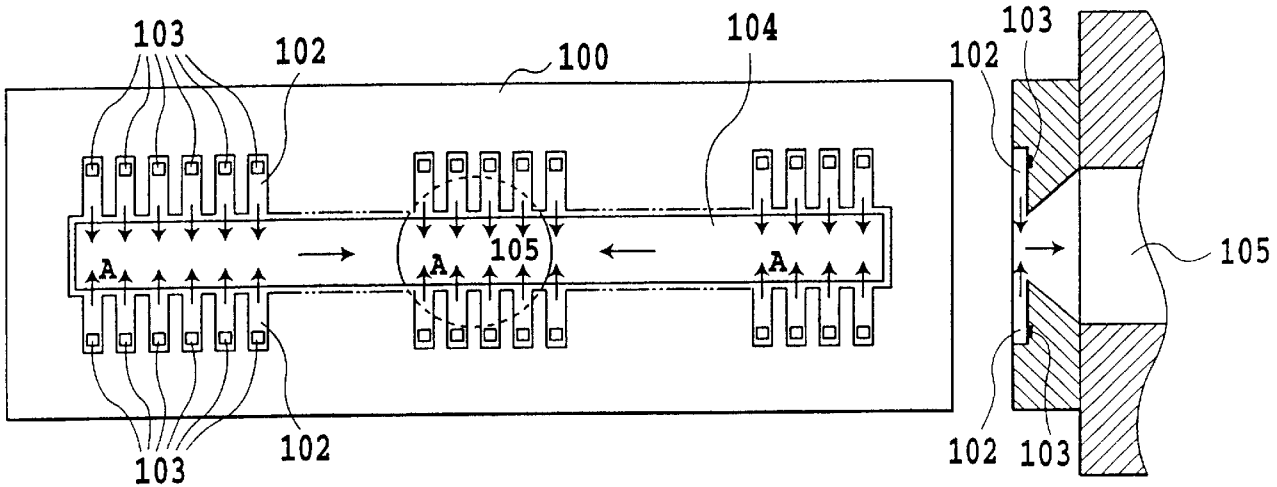
PRIOR ART FIG.20A
FIGS. 20A and 20B are sectional views that are each useful in explaining problems with refill in a print head according to a conventional example, as seen from an ejection opening side and from a lateral direction relative to the ejection opening side, respectively.
Figure 20B:
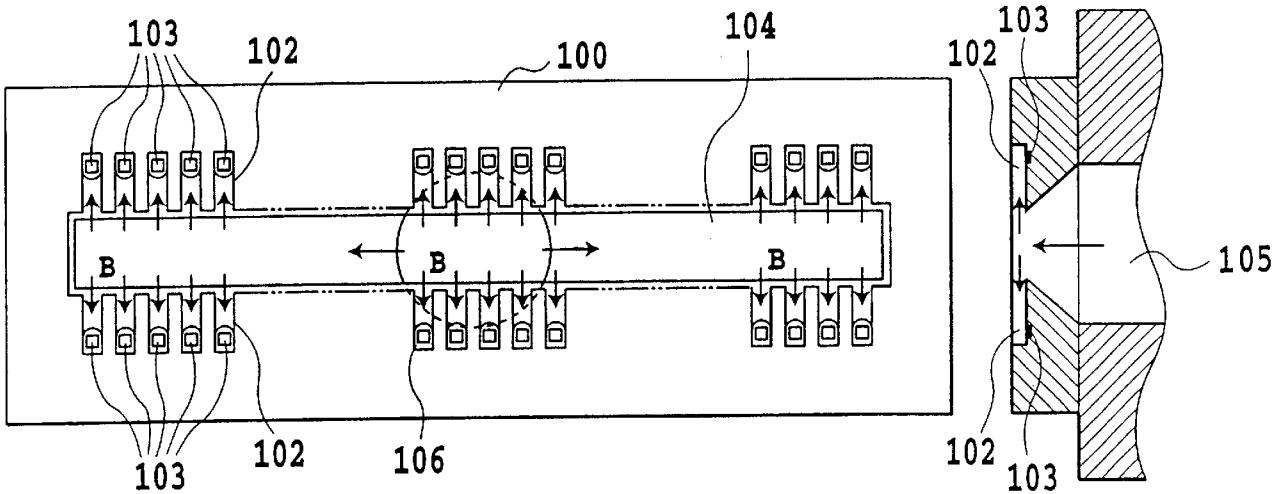
PRIOR ART FIG.20B
Figure 21A:
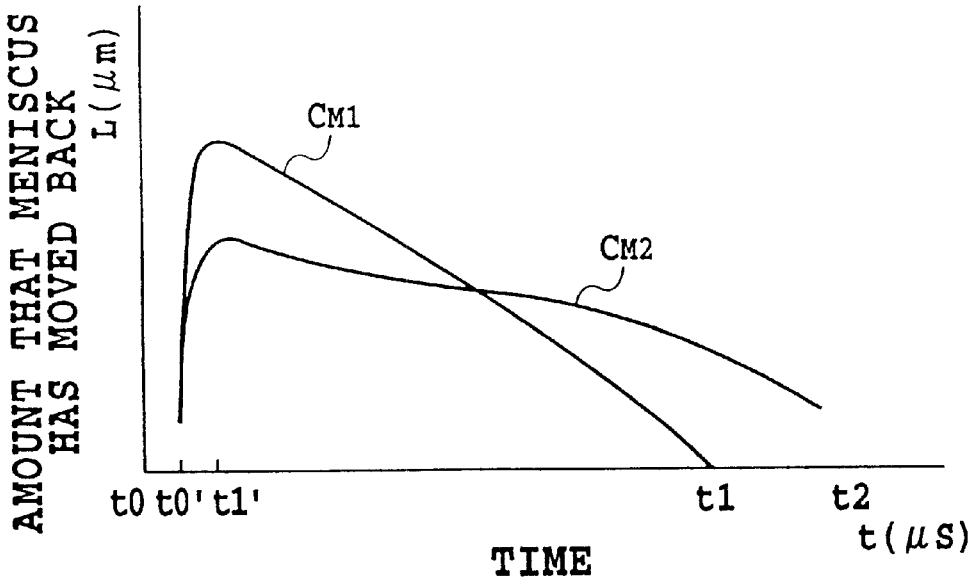
FIG.21A PRIOR ART
FIGS. 21A and 21B are a diagram and a sectional view that are useful in explaining problems with refill in a print head according to a conventional example, with the sectional view seen from a lateral direction relative to an ejection direction, respectively.
Figure 21B:
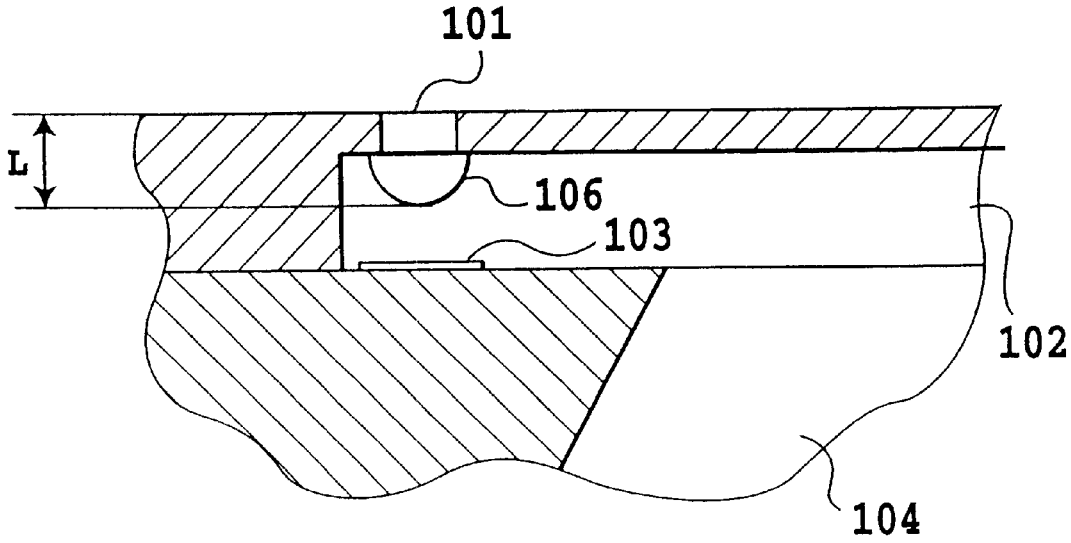
FIG.21B PRIOR ART

When the recesses 7 cannot be made sufficiently deep, a through-hole 23 is formed in the first support member 21 and a recess 24 is formed in the second support member 24 so as to communicate with the through-hole 23, as shown in FIG. 19. This configuration serves to form air chambers having a sufficient volume. Air chambers that are more effective on refill can be formed by varying the shape of the recess 24.

The above described print head according to each embodiment uses thermal energy generated by the electro-thermal conversion elements to induce film boiling in the liquid (ink) to form bubbles so that the pressure of the bubbles causes the ink to be ejected, as described above.

Here, superior effect obtained by the preferred embodiment shown in FIGS. 16A–16C, among the embodiments of the air chamber described above, will be explained below. The effect is specifically directed to that an effect of a low frequency vibration of the ink upon the ink supply can be decreased.

Figure 22A:
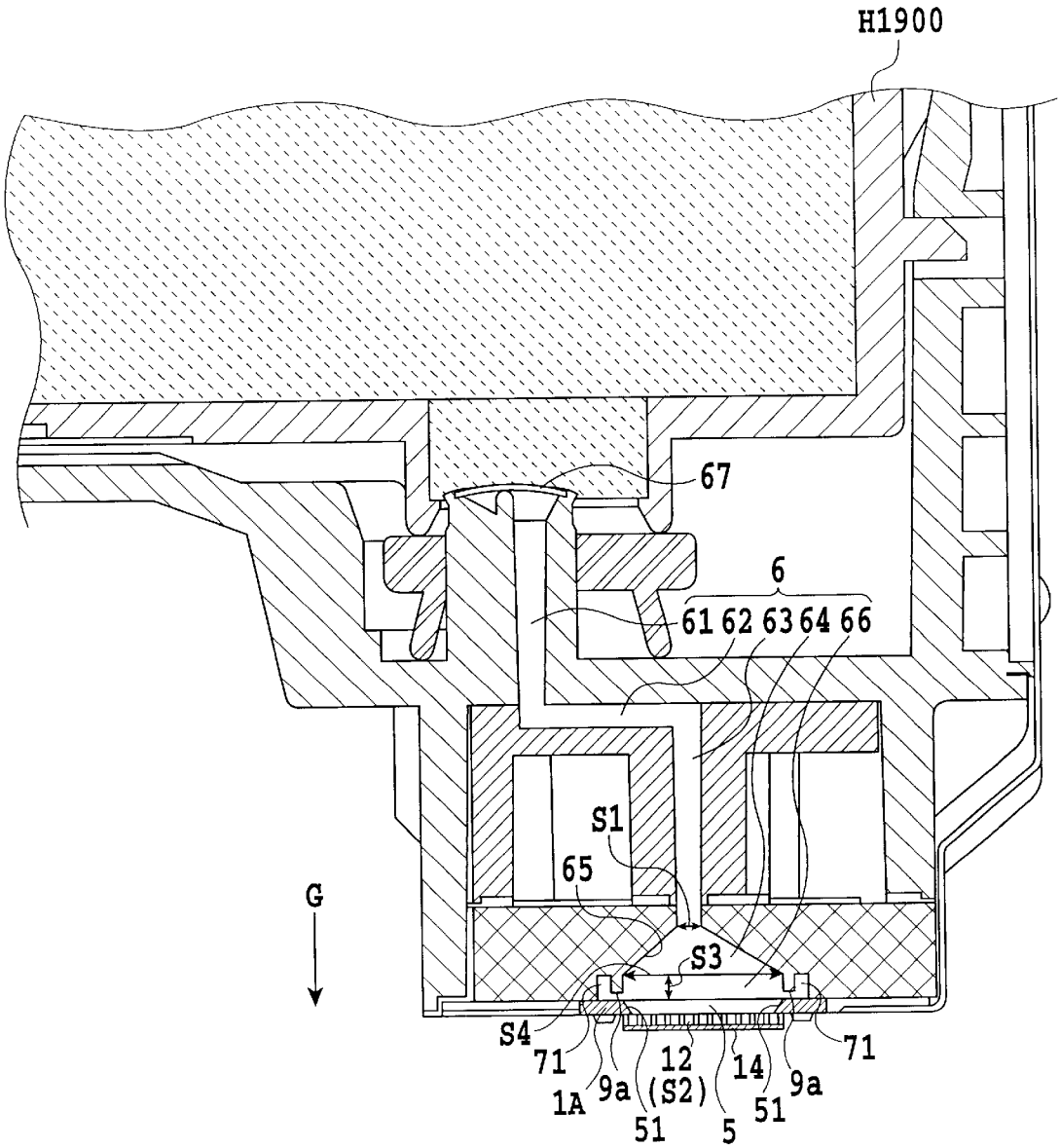
FIG. 22A is a sectional view showing a main part of an ink supply path from an ink tank to an ink ejection opening in a printing head according to an embodiment of the present invention.
Figure 22B:
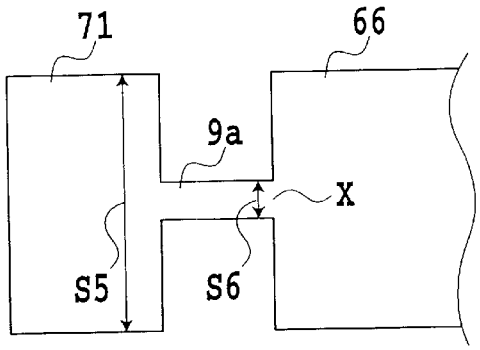
FIGS. 22B and 22C are plan view and perspective view, respectively showing an air chamber provided for the ink supply path.
Figure 22C:
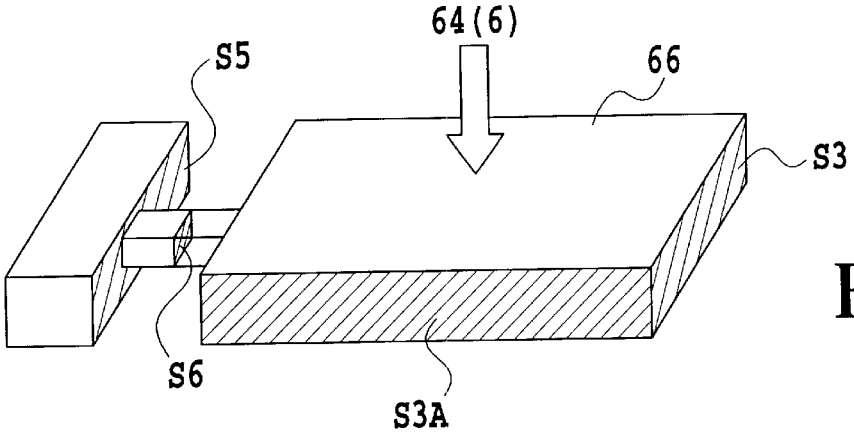
Figure 22D:
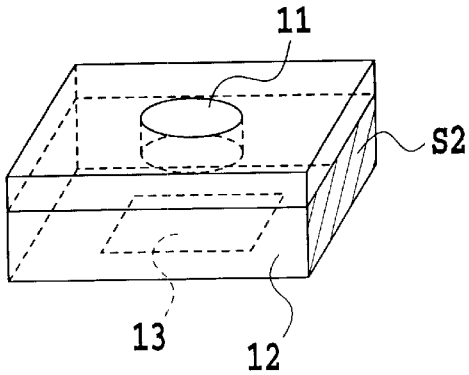
FIGS. 22D and 22E are perspective view and plan view, respectively showing a surrounding area of the ejection opening and an electro-thermal converting element in the ink supply path.
Figure 22E:
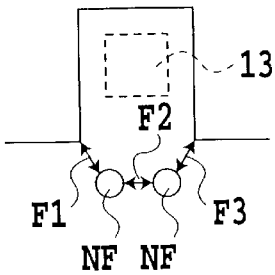

FIG. 22A is a sectional view showing a ink supply path obtained by connecting the printing head shown in FIGS. 16A–16C with the ink tank.

(General configuration of the ink supply path)

To a head chip including the substrate 1A, the partition walls, printing element substrate provided with the orifice plate 14 and the like, the ink passing through the ink tank H1900 as a ink supply source, a filter 67 and an ink supply path 6, sequentially, is supplied. The ink supply path 6 is formed by connecting a first ink supply part 61, a second ink supply part 62, a third ink supply part 63, a fourth ink supply part 64 and a fifth ink supply part 66, sequentially. Among the ink supply parts, the first and the third ink supply parts 61, 63 are elongated in a direction from the ink tank to a head portion, respectively. On the other hand, the second ink supply part is elongated in a direction which crosses the direction of the first and the third ink supply parts 61, 63. As a result of this, the first, the second and the third ink supply parts form a bending ink supply path.

(A configuration of a neighborhood of the air chamber)

The fourth ink supply part 64 is disposed successively to the fist, the second and the third ink supply parts. The fourth ink supply part 64 has a shape (inclined portions or taper potions 65) that a cross section area of the fourth ink supply part gradually increases from a third ink supply part side to a head chip side. Furthermore, successively to the fourth ink supply part, the fifth ink supply part 66 is disposed. The fifth ink supply part 66 is what has a constant cross section area. A member forming the fifth ink supply part 66 has a contact surface with the substrate 1A of the head chip. At corresponding portions within the contact surface to both ends of an arrangement of the electro-thermal converting elements on the print element substrate, the recess 7*a* for the air chamber and the groove 9*a* for the communicating path are formed.

The substrate 1A forming the head chip is disposed successively to the fifth ink supply part 66. A through hole space (ink supply port) 5, which is formed in the substrate 1A, has a tapered shape in which a cross section area of the through hole space decreases from a fifth ink supply part side to ink flow paths formed on the substrate. As a result, a first taper portion of the fourth ink supply part 64 and a second taper portion of the through hole space 5 are arranged and the air chamber 71 is disposed at an area at which respective inclined planes of the first and the second taper portions crosses each other.

(An alleviation effect upon a backward stream of the ink)

The configuration of the air chamber and the ink supply path according to the embodiment shown in FIG. 22A is effective in reducing an effect of the low frequency vibration of ink especially in the bubble through jet method.

FIGS. 24A–24H are views showing serial ejection states according to the bubble through jet method. As show in these figures, a bubble 301 generated by means of the electro-thermal converting element 13 communicates with an atmospheric air (see FIG. 24F) before an ink droplet is separated to fly from the head (see FIG. 24H), and therefor disappearing process of the bubble 301 does not exist. As a result, during generation and growth of the bubble, an interface between gas and liquid 301*a* formed at a back part of the bubble 301 moves back. Then, the backward movement of the interface causes the ink disposed backward is pressed to be moved to an ink supply path side. Especially when an ejection duty is high, the moved back ink, by a total amount thereof, makes a great effect upon a behavior of ink movement in the ink supply path. The applicant calls a vibration of the ink all over the ink supply path "low frequency vibration", in contrast to relatively high frequency vibration of the refill at ejection operation.

In this embodiment, the effect of the moved back ink upon the ink supply can be alleviated by means of both the second taper portion of the through hole space 5 formed in the head chip (the substrate 1A) and the first taper portion of the fourth ink supply part 64. More specifically, an action of the ink caused by an expanded path of the second taper portion and an action of the ink caused by deflection of a backward ink stream by the first taper portion allow the effect of a reflecting of the moved back ink upon successive ejection to be reduced.

(An effect of the air chamber)

The configuration of the first and second taper portions allows the effect of the vibration in a direction (longitudinal direction in FIG. 22A) along which the ink moves reciprocally to be alleviated, described above. However, a vibration of the ink in a direction (lateral direction in FIG. 22A) which crosses a direction of the ink supply is derived from the taper portions.

The air chamber of the embodiment functions as alleviating the effect of the lateral ink movement (vibration).

The arrangement of embodiment for the air chamber and the communicating path between the air chamber and the ink supply path is such that the air chamber and the communicating path are provided at a position along a direction crossing the ink supply direction, i.e. the lateral direction (an arrangement direction of the plurality of the liquid paths), and at a position which is faced by both the first and second taper portions. This arrangement allows the lateral vibration of the ink to be directly alleviated.

It is more preferable that pair of the air chambers are provided at opposite positions to each other because respective alleviation effects by air chambers are shown without interference with each other. Moreover, the air chamber forms a sealed space with a member for the head chip or the ink supply unit or members for both the head chip and the ink supply unit, except for a portion being contact with the ink to form the interface between gas and liquid. Then, it is guaranteed that an air received in the air unit effectively functions as a damper. The air chamber functioning as the damper may be interpreted as a storage member storing a part of the ink temporarily, from a different view.

When a meniscus of the ink is formed in the communicating path communicating the air chamber with the ink supply path, a responsibility in that the air chamber functions as the damper to alleviate the lateral vibration of the ink can be improved. In order to form the meniscus in the communicating path for improving the responsibility, a cross section area of the communicating path is determined within a predetermined range.

In the case of disposing the air chamber at a side area of ink supply path whose cross section area is small, the alleviation effect by the air chamber can not show because the ink stream (vibration) in the lateral direction is almost not caused. In addition, since an ink flow speed at a portion having small cross section area in the ink supply path is large, the alleviation effect can not show sufficiently. In contrast, in the case of disposing the air chamber at a side area of the ink supply path whose cross section area is large, the sufficient alleviation effect can be shown by the air chamber even if the air chamber has relatively small size. Moreover, a cross section area of the communicating path communicating the air chamber with the ink supply path is determined to be larger than the cross section area of the ink flow path so that the air chamber functions as the damper.

The cross section area of portions of the printing head according to the embodiment are shown below.

The cross section area S5 of the air chamber 71 (FIG. 22B, FIG. 22C): 0.765 $mm^2$, the cross section area S6 of the communicating path (9*a*) (FIG. 22B, FIG. 22C): 0.08 $mm^2$, the cross section area S1 of the third ink supply part 63 (FIG. 22A): 0.64 $mm^2$, the cross section area S2 of the ink flow path 12 (FIG. 22D, FIG. 22A): 0.000416 $mm^2$, the cross section areas F1, F2, F3 of gates of the ink flow path (FIG. 22E): 0.000143 $mm^2$.

(An effect of the ink supply path upon ink supply)

Figure 24H:
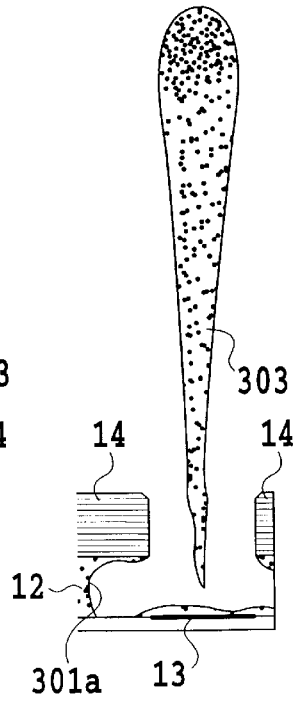

Also in the bubble through jet method, the bubble is generated and grows n the ink so that the ink is ejected. However, the meniscus formed with the interface between gas and liquid of the bubble is positioned behind the electro-thermal converting element when the above ejection is performed, as shown in FIG. 24H. This moved back meniscus can be returned to a position where the ink ejection is able to be executed only by the capillary force. The capillary force caused in each of the ink low paths, as a whole, results in the ink in the ink supply path moving. For this ink movement, the ink supply path of the embodiment has a configuration that the cross section area of the ink supply path gradually increases from an upper stream of the ink supply path to lower stream of the same. This configuration allow the ink supply from the upper stream to be smoothly performed and prevent a lack of ink supply.

Further, the air chamber is disposed adjacent to the fifth ink supply part and then ink contemporary stored in the air chamber can be supplied to the head chip upon ink ejection so that the air chamber functions as a part of ink supply source.

(An effect of the air chamber showing in relation to a position of the head unit)

The printing head of the embodiment is used in a manner that ink is ejected downwards. In the ejection downward, the gravity acts upon the ejection as shown by an arrow G in FIG. 22A. For this case, the ink supply unit is disposed above the head chip and the air chamber is disposed at an ink supply unit side with respect to connection portion between the ink supply unit and the head chip. Further, the air chamber has a shape that the chamber is elongated upward so that a volume efficiency of the air chamber is improved.

(An effect of an additional configuration)

An arrangement that a plurality of dummy ejection openings is provide at both ends of low of the ejection openings is known. The dummy openings allow an effect of a back wave (cross talk) to be reduced. Therefor, when both the air chamber and the dummy openings are provided, the alleviation effect upon the vibration of ink may be further improved. Further, the ink supply path having bending path of the embodiment functions as directly alleviating the backward movement of ink from the head chip.

Configurations of the head and the air chamber shown in FIGS. 16A–16C (FIGS. 22A–22E) is preferable to especially reduce the effect of the low frequency vibration of the ink upon the ink ejection so that good ejection state is realized, even if the head has a compact structure. Configurations of other embodiments except the configuration shown in FIGS. 16A–16C rather reduces a high frequency vibration of ink effectively, but must have relatively many air chamber to become large sized one.

As is apparent from the above description, according to the embodiments of the present invention, the air chambers, which communicates with the ink supply chamber common to the plurality of ink ejection openings for supplying the ink to these ink ejection openings and to which the pressure is transmitted from the ink supply chamber, is provided. Accordingly, the pressure caused upon ejection of the ink in each ejection opening and propagated to the ink supply chamber also propagates to the air chamber as a change in the pressure of the air in the air chamber and is absorbed due to a compression of an air in the air chamber.

In addition, since the air chambers are provided at the opposite side of the ejection openings with respect to the print element substrate, the air chamber does not communicate with the atmosphere, thereby preventing the ink in the print head from being made more viscous through the air chambers.

As a result, the disadvantages relating to ink refill specific to an increase in the number of ink ejection openings of the ink jet print head can be eliminated to provide a particularly excellent fast-response capability and ejection performance.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A print head comprising:

a print element substrate having a substrate on which an ejection energy generating element for generating thermal energy that is used for ejecting ink is provided, and an ejection opening plate which is provided on the substrate and in which an ejection opening is provided so that the ejection opening faces the ejection energy generating element; and a support member being in contact with the substrate to support said print element substrate, wherein an ink supply path supplies the ink to the ejection opening on said print element substrate, wherein an air chamber that communicates with the ink supply path and includes an air are provided, wherein at least a part of an inner wall of the air chamber is formed with said support member, and wherein a recess is formed in said print element substrate, and said support member and said print element substrate are connected to each other so that the recess forms a space corresponding to the air chamber.

2. A print head comprising:

a print element substrate having a substrate on which an ejection energy generating element for generating thermal energy that is used for ejecting ink is provided, and an ejection opening plate which is provided on the substrate and in which an ejection opening is provided so that the ejection opening faces the ejection energy generating element; and a support member being in contact with the substrate to support said print element substrate, wherein an ink supply path supplies the ink to the ejection opening on said print element substrate, wherein an air chamber that communicates with the ink supply path and includes an air are provided, wherein at least a part of an inner wall of the air chamber is formed with said support member, and wherein a through hole forming the ink supply path is provided in the substrate, and an inner wall of the through hole has a inclined surface so that the through hole becomes gradually narrower from an upper stream to a down stream of an ink supply.

3. A print head as claimed in claim 2, wherein the air chamber communicates with the ink supply path at an end area of the inclined surface.

4. A print head comprising:

a print element substrate having a substrate on which an ejection energy generating element for generating thermal energy that is used for ejecting ink is provided, and an ejection opening plate which is provided on the substrate and in which an ejection opening is provided so that the ejection opening faces the ejection energy generating element; and a support member being in contact with the substrate to support said print element substrate, wherein an ink supply path supplies the ink to the ejection opening on said print element substrate, wherein an air chamber that communicates with the ink supply path and includes an air are provided, wherein at least a part of an inner wall of the air chamber is formed with said support member, and wherein an inner surface of the air chamber is processed to be water repellent.

* * * * *

UNITED STATES PATENT AND TRADEMARK OFFICE

CERTIFICATE OF CORRECTION

PATENT NO. : 6,557,989 B1 
DATED : May 6, 2003
INVENTOR(S) : Toshiaki Hirosawa et al.

It is certified that error appears in the above-identified patent and that said Letters Patent is hereby corrected as shown below:

Title page,
Item [57], ABSTRACT,
Line 2, “is” should read -- are --.

Column 1,
Line 14, “associated” should read -- association --;
Line 32, ““ejection” should read -- as “ejection --;
Line 41, “a on-demand” should read -- an on-demand --; and
Line 54, “operations” should read -- operation --.

Column 5,
Line 10, “that” should read -- so that --;
Line 12, “an air” should read -- air --;
Line 18, “the air,” should read -- air, --;
Line 20, the air” should read -- air --;
Line 48, “provide” should read -- provided --;
Line 55, “a ink” should read -- an ink --; and
Line 64, “An first” should read -- A first --.

Column 6,
Line 10, “following” should read -- the following --;
Line 16, “Further” should read -- A further --;
Lines 27 and 45, “contact” should read -- in contact --; and
Lines 32 and 50, “an air” should read -- air --.

Column 7,
Lines 31 and 48, “receive” should read -- receives --;
Line 59, “communicates” should read -- communicate --;
Line 62, “is provided.” should read -- are provided. --; and
Line 67, “an air” should read -- air --.

Column 8,
Line 10, “lest” should read -- least one --;
Line 12, “position” should read -- positioned --; and
Line 21, “than” should read -- from --.

UNITED STATES PATENT AND TRADEMARK OFFICE

CERTIFICATE OF CORRECTION

PATENT NO. : 6,557,989 B1
DATED : May 6, 2003
INVENTOR(S) : Toshiaki Hirosawa et al.

It is certified that error appears in the above-identified patent and that said Letters Patent is hereby corrected as shown below:

Column 12,
Line 42, “contract” should read -- contact --;
Line 43, “not” should read -- (not --; and
Line 44, “shown,” should read -- shown), --.

Column 13,
Line 6, “not shown” should read -- (not shown) --.

Column 16,
Line 10, “devices, not shown” should read -- devices (not shown), --; and
Line 21, “devices, not shown,” should read -- devices (not shown), --.

Column 17,
Line 47, “these” should read -- this --.

Column 18,
Line 21, “steps” should read -- step --.

Column 20,
Line 4, “degrees(a” should read -- degrees (a --;
Line 24, “H1103.namely,” should read -- H1103. Namely, --;
Line 38, “any of” should read -- of any --; and
Line 65, “FIGS.” should read -- FIG. --.

Column 21,
Line 30, “consists” should read -- consisting --; and
Line 31, “as a” should read -- as an --.

Column 22,
Line 42, “above. As” should read -- above, as --; and
Line 50, “absorb” should read -- absorbs --.

Column 23,
Line 17, “can be” should read -- to be --;
Line 44, “directly” should read -- is directly --;
Line 63, “the above it,” should read -- above -- and “section” should read -- a section --.

UNITED STATES PATENT AND TRADEMARK OFFICE

CERTIFICATE OF CORRECTION

PATENT NO. : 6,557,989 B1
DATED : May 6, 2003
INVENTOR(S) : Toshiaki Hirosawa et al.

It is certified that error appears in the above-identified patent and that said Letters Patent is hereby corrected as shown below:

Column 24,
Lines 6 and 28, “More over,” should read -- Moreover, --;
Line 7, “apparent” should read -- as is apparent --;
Line 9, “that a” should read -- that an --;
Line 10, “nearer” should read -- a point nearer --; and
Line 12, “broaden” should read -- broadened --.

Column 25,
Line 38, “to that” should read -- so that --;
Lines 42 and 49, “a ink” should read -- an ink --; and
Line 64, “fist,” should read -- first, --.

Column 26,
Line 20, “crosses” should read -- cross --;
Line 27, “show” should read -- shown --; and
Line 37, “pressed” should read -- to be pressed --.

Column 27,
Line 7, “pair” should read -- a pair --;
Line 13, “contact” should read -- in contact --;
Lines 29 and 33, “can not” should read -- cannot --; and
Line 55, “grows n” should read -- grown in --.

Column 28,
Line 1, “allow” should read -- allows --;
Line 4, “contemporary” should read -- then --;
Line 21, “provide” should read -- provided -- and “of low” should be deleted;
Line 23, “Therefor,” should read -- Therefore, --;
Line 30, “is preferable” should read -- are preferable --;
Line 35, “reduces” should read -- reduce --;
Line 37, “chamber” should read -- chambers -- and “large” should read -- a large --;
Line 39, “chambers,” should read -- chamber, --; and
Line 48, “an air” should read -- air --.

UNITED STATES PATENT AND TRADEMARK OFFICE

CERTIFICATE OF CORRECTION

PATENT NO. : 6,557,989 B1
DATED : May 6, 2003
INVENTOR(S) : Toshiaki Hirosawa et al.

It is certified that error appears in the above-identified patent and that said Letters Patent is hereby corrected as shown below:

Column 29,
Line 15, “an air” should read -- air --.

Column 30,
Lines 2 and 28, “an air” should read -- air --; and
Line 7, “a inclined” should read -- an inclined --.

Signed and Sealed this

Thirteenth Day of January, 2004

JON W. DUDAS
*Acting Director of the United States Patent and Trademark Office*